US010465462B2

(12) United States Patent
Frazier et al.

(10) Patent No.: US 10,465,462 B2
(45) Date of Patent: Nov. 5, 2019

(54) ELECTRICALLY POWERED SETTING TOOL AND PERFORATING GUN

(71) Applicant: Magnum Oil Tools International, Ltd., Corpus Christi, TX (US)

(72) Inventors: W. Lynn Frazier, Corpus Christi, TX (US); Timothy Kenneth McAdoo, Bedford, TX (US); Lee Schiro, Robstown, TX (US); Wade Ashley Koehl, Inez, TX (US); Richard Charles Zeinert, Carrollton, TX (US)

(73) Assignee: MAGNUM OIL TOOLS INTERNATIONAL, LTD., Corpus Christi, TX (US)

( * ) Notice: Subject to any disclaimer, the term of this patent is extended or adjusted under 35 U.S.C. 154(b) by 649 days.

(21) Appl. No.: 14/922,969

(22) Filed: Oct. 26, 2015

(65) Prior Publication Data

US 2016/0115753 A1 Apr. 28, 2016

Related U.S. Application Data

(60) Provisional application No. 62/122,597, filed on Oct. 24, 2014.

(51) Int. Cl.
*E21B 23/06* (2006.01)
*E21B 43/1185* (2006.01)

(52) U.S. Cl.
CPC ..... *E21B 23/06* (2013.01); *E21B 43/1185* (2013.01)

(58) Field of Classification Search
CPC ..... E21B 23/06; E21B 43/1185
See application file for complete search history.

(56) References Cited

U.S. PATENT DOCUMENTS

| | | | | |
|---|---|---|---|---|
| 3,381,751 | A | 5/1968 | McLelland | |
| 4,185,705 | A * | 1/1980 | Bullard | E21B 4/16 175/78 |
| 4,203,840 | A | 5/1980 | Stoeppler et al. | |
| 4,208,966 | A | 6/1980 | Hart | |
| 4,335,730 | A | 6/1982 | Griffin | |
| 4,554,973 | A | 11/1985 | Shonrock et al. | |
| 5,303,776 | A | 4/1994 | Ryan | |
| 5,332,038 | A | 7/1994 | Tapp et al. | |
| 5,492,173 | A * | 2/1996 | Kilgore | E21B 23/06 166/66.4 |
| 6,042,513 | A | 3/2000 | Koteles et al. | |

(Continued)

FOREIGN PATENT DOCUMENTS

EP 2006486 12/2008

OTHER PUBLICATIONS

EBFire Guide Book, Hunting, Hunting Titan, Hunting Energy Services, 25 pages Dec. 31, 2013.

(Continued)

*Primary Examiner* — Matthew R Buck
(74) *Attorney, Agent, or Firm* — Jackson Walker, LLP

(57) ABSTRACT

An electric setting tool powered through a cable or wire line for setting bridge plugs or other settable downhole tools and which may be used in conjunction with a select fire perforating gun. The electric setting tool is adapted to receive DC power and set a tool in the range of 20 to 60 seconds while operating at under 2.0 amps. The composite tool may be comprised of multiple perf guns subs, the electric setting tool, and bridge plug or other settable tool.

32 Claims, 26 Drawing Sheets

(56) References Cited

U.S. PATENT DOCUMENTS

| | | | | |
|---|---|---|---|---|
| 6,199,628 | B1 * | 3/2001 | Beck | E21B 23/06 166/53 |
| 7,004,045 | B2 | 2/2006 | Cox | |
| 7,051,810 | B2 * | 5/2006 | Clemens | E21B 31/00 166/117.6 |
| 7,367,397 | B2 * | 5/2008 | Clemens | E21B 31/107 166/178 |
| 7,467,661 | B2 * | 12/2008 | Gordon | E21B 43/112 166/298 |
| 7,559,364 | B2 * | 7/2009 | Bullard | E21B 23/06 166/179 |
| 7,562,700 | B2 * | 7/2009 | Lewis | E21B 29/005 166/298 |
| 7,757,756 | B2 * | 7/2010 | Bullard | E21B 33/134 166/181 |
| 8,264,814 | B2 | 9/2012 | Love et al. | |
| 8,272,439 | B2 | 9/2012 | Strickland | |
| 9,222,555 | B2 * | 12/2015 | Morin | F16H 19/04 |
| 9,316,077 | B2 * | 4/2016 | Clemens | E21B 23/08 |
| 9,476,289 | B2 * | 10/2016 | Wells | E21B 33/134 |
| 9,689,220 | B2 * | 6/2017 | MacLeod | E21B 23/06 |
| 2011/0066378 | A1 | 3/2011 | Lerche et al. | |
| 2011/0073328 | A1 | 3/2011 | Clemens et al. | |
| 2013/0300569 | A1 | 11/2013 | Lerche et al. | |
| 2014/0301686 | A1 | 10/2014 | Cornelius | |
| 2015/0068723 | A1 | 3/2015 | Wells | |
| 2017/0284167 | A1 | 10/2017 | Takahashi et al. | |

OTHER PUBLICATIONS

Pulse, Omega Well Monitoring, Technical Specification, Memory Tools, 3 pages Dec. 31, 2014.

Hunting, EMFire, www.hunting-intl.com/titan/wireline-selective-firing-systems/ebfire, 2 pages Dec. 31, 2014.

Interwell Electronic Setting Tool (EST), www.interwell.com, 2 pages Dec. 31, 2011.

Star Oil Tools, Starset Wireline Setting Tool, www.staroiltools.com/WT.htm, 1 page Dec. 31, 2011.

Openfield Technology, 1/2" Pressure and Temperature Micro-Recorder, www.openfield-technology.com, 2 pages Dec. 31, 2013.

Minarik Automation & Control, Thomson PPA00-01B65-04, store.minarik.com/product/Im_actuators/thomson/PPA00-01B65-04, 2 pages Oct. 10, 2014.

Thomson Linear Actuators, www.thomsonlinear.com, 66 pages Dec. 31, 2014.

Halliburton, Wireline & Perforating Downhole Power Ulnit (DPU)—Intelligent Series Tool, 2 pages Dec. 31, 2011.

* cited by examiner

Fig. 1
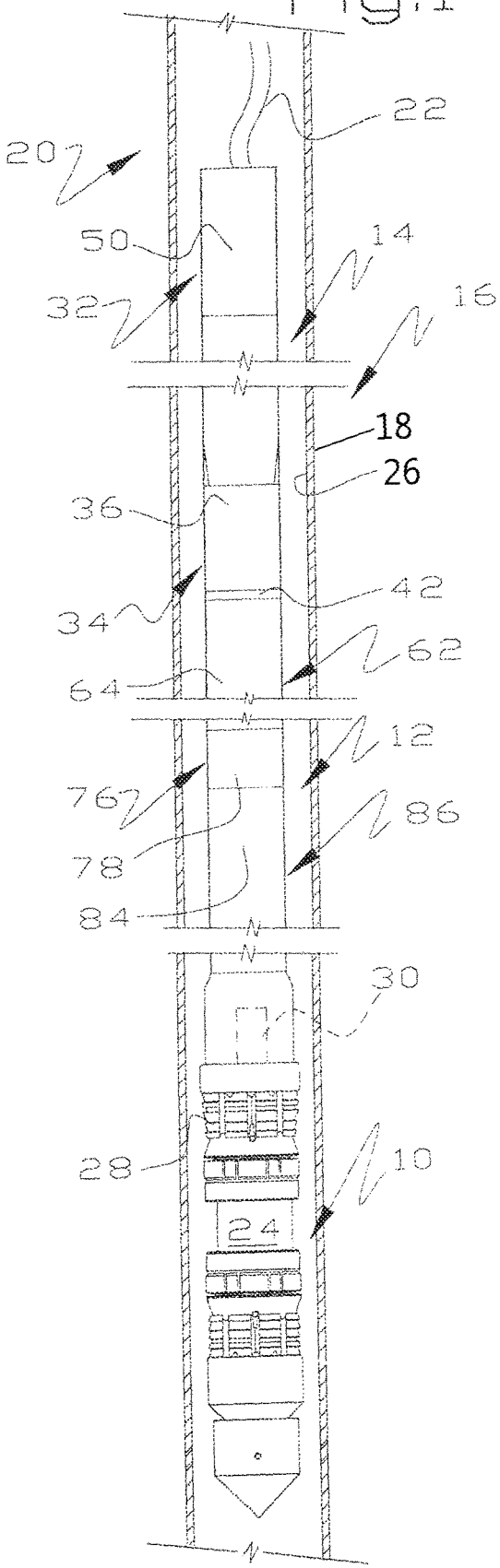
Fig. 3
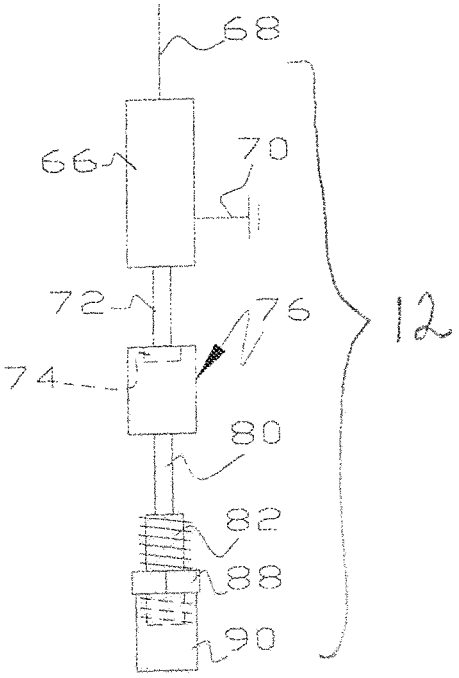
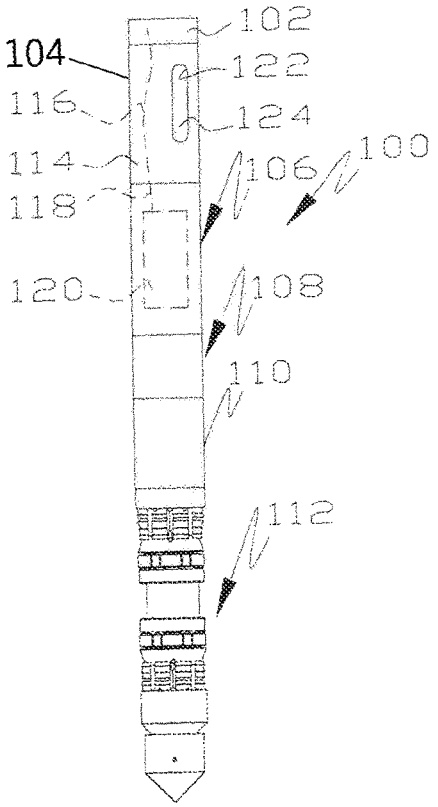
Fig. 4

MOTOR MODULE HOUSING. 224
LOCK RING/NUT. 260
256
RESOLVER ASSEMBLY. PROVIDES MOTOR ROTOR POSITION FEEDBACK TO THE DRIVE.
MOTOR OUTPUT SHAFT.

FRAMELESS DC MOTOR. 214
261
238
268
262
DOUBLE ROW ANGULAR CONTACT BEARING.
268a 268
268B
MOTOR SHAFT. 214
264

BEARING. 266
RESOLVER. 264
RESOLVER HOUSING. 261
NOTES:

e
e
214a
269
268

214b
214a 217
219
221
223c
223b
223a
223
219
215

215d
215c
215b
215a

ROLLER SCREW MODULE HOUSING 230
244
THRUST BEARING. 314
310
POLISHED ROD THREADS INTO NUT
242
POLISHED ROD/FORCE TUBE
244

314
ROLLER SCREW NUT 310
ROLLER SCREW
308

SPLINED INPUT DISK 306
THRUST BEARING KEEPER SECTIONS 321a-c
320
314a
322
308

THRUST BEARING 314
KEEPER SECTION CAP
TK

THRUST BEARING 314
SCREW 308
A
A
KEEPER CAP 323
308a
SECTION A-A
SCALE 1 : 1.5
308
325
KEEPER SECTIONS 321a-c

323
SCREW
308
325
320
314

321a-c

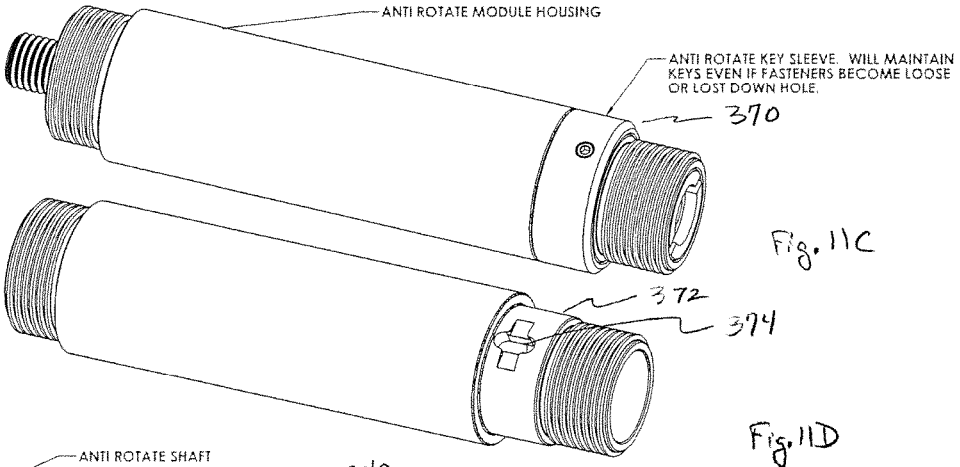
Fig. 11C
Fig. 11D
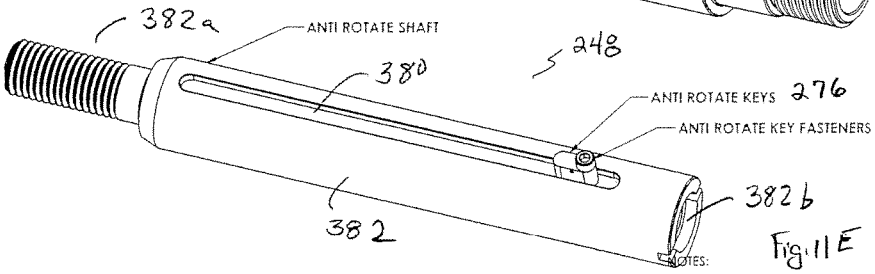
Fig. 11E

ELECTRICALLY POWERED SETTING TOOL AND PERFORATING GUN

This non-provisional application claims priority to U.S. Provisional Application 62/122,597, filed Oct. 24, 2014, which is incorporated herein by reference.

BACKGROUND OF THE INVENTION

Bridge plugs or other settable well tools are widely used in completing oil and gas wells, such as in the horizontal leg of a horizontal well. In some situations, a bridge plug is set in casing in such a well before perfing and fracing a hydrocarbon bearing formation above the bridge plug. One conventional technique is to attach a ballistic setting tool below a select fire perforating gun. A ballistic setting tool incorporates a relatively slow burning propellant to deliver a quantity of high pressure gas to operate a piston mechanism to pull on a mandrel of the bridge plug and thereby expand the bridge plug into sealing engagement with the inside of a casing string.

Ballistic setting tools have been attached to the bottom of a select fire perforating gun. Thus, a bridge plug can be set followed by perforating an interval in preparation for fracing, without tripping the tool to the surface.

Disclosures of some interest relative to this invention are found in U.S. Pat. Nos. 4,144,973; 7,149,364 and 7,757,756; U.S. Printed Patent Application 20110073328, a publication of One Petro entitled A Battery Operated, Electro-Mechanical Setting Tool for Use With Bridge Plugs and Similar Wellbore Tools, Offshore Technology Conference, 1 May-4 May 1995 and EB Fire, a publication of Hunting International of Houston, Tex. and a two page publication of Weatherford entitled Nonexplosive Setting Tool dated 2013.

Electrically powered setting tools appear to be of two types: (1) battery powered motors where the tool includes a compartment for a number of batteries and (2) motors powered through a wireline suspending the tool in a well. This invention relates to the second type, i.e. where power is delivered to the tool through a wire or cable extending from the tool to the surface, which has the obvious advantage of being operable without contending with batteries, i.e. are they sufficiently charged or are they affected by temperature or a combination of time and temperature.

SUMMARY OF THE INVENTION

In one aspect, a setting tool is electrically powered through a cable or wireline and has the capability of setting well tools (e.g., bridge plugs, packers and the like) and which may be used in conjunction with a select fire perforating gun of conventional design. This means the setting tool can be used in situations where it is desired to set a bridge plug or similar tool in a well in preparation for fracing a formation. When incorporated on the bottom of a select fire perforating gun, the setting tool can be powered through the same electric circuit used to fire the perforating gun without modifying the perforating gun. No known setting tool powered by electricity through wireline has the capability of setting bridge plugs quickly enough to be acceptable to industry.

Conventional select fire perforating guns operate at 300-600 volts dc. The motors of conventional electrically powered setting tools consume electricity in this range at an amperage in excess of the capability of conventional select fire perforating guns. Although the industry standard for amperage values may change with time, the present standard for select fire perforating guns is now 1.9 amps. Amperages in excess of this value burn out switches in the perforating gun, rendering it inoperable. The alternative is to operate the setting tool at a low enough amperage to pass through the perforating gun. The effect is to slow down conventional setting tool motors and prolong the time to set a bridge plug to a value, such as about 5-20 minutes, which is unacceptable to industry. In these types of operations, many detrimental things can happen in 5-20 minutes, and no one wants to take such risks. This is the reason ballistically operated setting tools are the industry standard for use with select fire perforating guns.

A slow set is better for the plugs so they are not slammed together like in a violent ballistic explosive set. In plastic or composite plugs, a mandrel being pulled or the exterior plastic or composite parts being pushed to set the plug in about 20-30 seconds is ideal. Taking minutes to set a plug is sometimes a problem. Accuracy of the setting depth, for example, is very important. When you wait minutes, the plug moves due to line creep, especially when you pump or reel off a couple of miles of cable, the line may begin shrinking or lengthening due to well conditions, i.e. pressures, temperatures, etc., and weight being put on the line or taken off the line, over this time frame, causes this phenomenon as well. About 20 sec-60 sec of set time, such as can be provided in the embodiments disclosed, at tensile forces up to 25,000 pounds, is preferred. Shorter than that, the violent setting may damage the plastic or composite plug, and longer than 60 seconds then plug the may creep up or down the hole and cause setting depth accuracy issues.

In the disclosed device, setting times in the range of about 20-60 seconds are obtained by delivering dc power through the cable or wireline on which the tool is delivered into and retrieved from the well.

Applicants' novel tool is environmentally safe. It removes the need for handling of live explosives; removes the need to bleed high pressure gas on surface after each run; and creates no oil, no soot, and no redress design.

The tool also eliminates added cost of power charges and igniters; on location setting tool redress; the need for multiple setting tools on location; the need for explosive licensing (foreign countries especially); oil level mistakes; and storage and inventory of explosives.

It features compatibility with multiple implements. It is a direct replacement for conventional setting tools; will not harm conventional wireline equipment; uses standard shooting sub connections and uses thread crossovers to adapt to most conventional plug and packer setting equipment Another advantage is risk mitigation. Computer controlled stroke speed delivers a consistent, precise toolset. It allows more time to be spent preparing the well tool (e.g., plug or packer) instead of the setting tool. It eliminates faulty setting tool redress due to operator fatigue on location. It also provides a clear indication full stroke achievement on surface during toolset Its real time and stored data collection capabilities include at least: pressure, temperature, time and stroke count, stroke length and speed.

BRIEF DESCRIPTION OF THE DRAWINGS

FIG. 1 is an exterior view of an example electrically powered setting tool on the bottom of a conventional select fire perforating gun.

FIG. 3 is a schematic view of the electrically powered setting tool.

FIG. 4 is a schematic view of another embodiment of this invention.

FIGS. 11A-11E illustrate various views of the anti-rotation module of the electric setting tool.

DETAILED DESCRIPTION OF THE INVENTION

Electrically powered setting tools have theoretical inherent advantages over ballistic setting tools. A ballistic setting tool includes a propellant charge which, when ignited, delivers a large quantity of gases into a chamber to drive a piston in a direction pulling the mandrel of a bridge plug and thereby radially expanding the bridge plug. After each use, the ballistic setting tool has to be disassembled, the pressure chamber thoroughly cleaned, all O-rings or other seals replaced and then reassembled in preparation for being used again. In a situation where multiple bridge plugs, for example twenty, are to be set in a well, the service company has to have enough setting tools at the well location to set all of the proposed bridge plugs plus a few spares because the disassembly work has to be done in a shop which may be many miles and many hours from the well location. An electrically powered setting tool has none of these disadvantages and can be used, perhaps hundreds of times, before maintenance is required. On the other hand, current model electrically powered setting tools of the type powered down the wireline are not sufficiently flexible to be used in all circumstances, such as on the bottom of select fire perforating guns.

In particular implementations, the electric setting tool has a drivetrain (motor assembly, gear assembly, linear actuator) that is adapted, through motor power output, drivetrain configuration, including the mechanical advantage achieved thereby and the efficiency thereof, to, on a current of less than about 1.9 Amps, achieve a stroke of between about 3 inches and 12 inches at a force of between about 15 K and about 50 K pounds in the time of between about 20 and about 120 seconds. The electric setting tool is engaged, in one embodiment, to a settable implement such as a bridge plug, downhole thereof and one or more perf subs up hole thereof to provide a composite tool capable of setting the downhole tool, and firing one or more perf guns then removal from the well.

Figure 2:
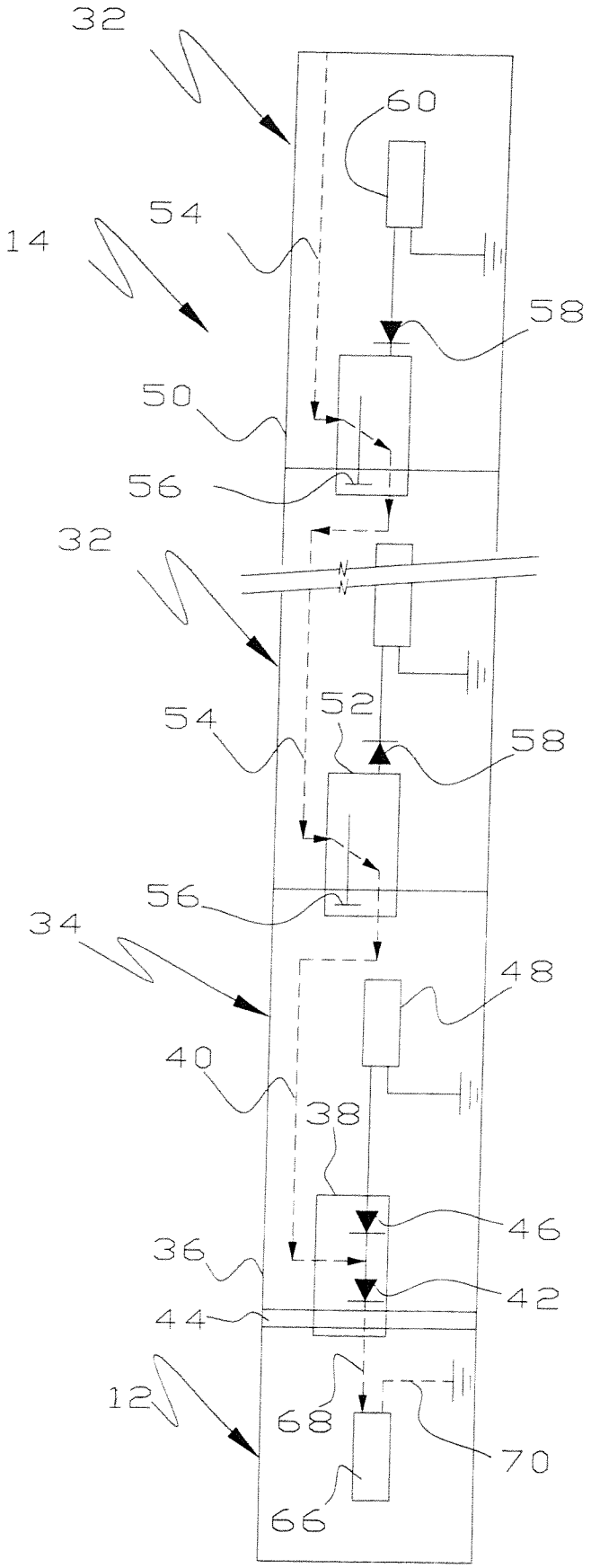
FIG. 2 is a schematic view of the electrical circuit through the perforating gun and into the electrically powered setting tool.

Referring to FIGS. 1-3, a bridge plug or other settable well tool 10 is attached to an electrically powered setting tool 12 which is, in turn, attached to a select fire perforating gun 14 thereby comprising a composite tool 16 which may be used in a well bore 18 of a hydrocarbon well 20, the well bore being defined by a casing 26. The well bore may be vertical or having a horizontal leg 20*a*. The tool 16 may be delivered into and/or retrieved from the well bore 18 by an insulated wireline or cable 22 of conventional type.

The bridge plug 10 may be of conventional type such as offered by Magnum Oil Tools International of Corpus Christi, Tex. Numerous models of its bridge plugs are shown at http://www.magnumoiltools.com/products. Typical bridge plugs are currently made of composite or plastic materials and are normally easily drilled up or dissolve over time. Typical bridge plugs 10 include a rubber or packing element 24 which is expanded to seal against the interior of the casing 26 or well bore 18, slips 28 for gripping the interior of the casing 26 and a mandrel 30 which is pulled to expand the bridge plug 10 from a contracted transport position to an expanded position 10 against the casing 26. As will be recognized by those skilled in the art, the mandrel 30 is pulled upwardly while the upper end of the bridge plug 10 abuts the bottom of the setting tool 12 and expands radially against the casing 26. Typical bridge plugs are shown in U.S. Pat. Nos. 6,796,376; 8,307,892 and 8,496,052 which are incorporated by reference herein and to which reference is made for a more complete description thereof.

The select fire perforating gun 14 may be of a conventional type such as shown in EB Fire or its Gun Systems and Accessories Catalog http://www.hunting-intl.com/pdfviewer/Titan/Titan_GunSystemsAccessories2014_Catalog/Titan_GunSystemsAccessories2014_Catalog/index.html, a publication of Hunting International of Houston, Tex. Select fire perforating guns 14 normally are assembled from identical components at a well location to produce a lowermost gun sub 34 and a series of substantially identical sections or gun subs 32 above the lowermost gun sub 34. The lowermost gun sub 34 typically includes a housing 36 having therein a positive dual diode switch 38 and a circuit path 40 connected to the setting tool 12 through a first diode 42 and a connector collar 44. The circuit path 40 also connects through a second diode 46 to a blasting cap or igniter 48 which sets off a shaped charge (not shown). In operation, positive dc current less than the amperage limit of the switch 38 can pass through the cable 22 into the lowermost gun sub 34 to power the setting tool 12 as will become more fully apparent hereinafter. Such positive dc current cannot pass through the diode 46 and accordingly does not detonate the igniter 48. Although the industry standard is for the lowermost gun sub 34 to pass positive dc current, it will be apparent the sequence of positive and negative gun subs 32, 34 may be reversed.

The gun subs 32 may each include a housing 50 having therein a pressure or pulse operated switch 52 and a circuit path 54 leading through the switch 52 to the subjacent gun sub. When the subjacent gun sub goes off, pressure or a pressure pulse moves a piston 56 to sever the electrical connection to the subjacent gun sub and connect the circuit path 54 to a diode 58 of opposite polarity to the diode in the subjacent gun sub. The diode 58 connects to an igniter 60 so that dc current of the correct polarity can set off the shaped charge (not shown). In accordance with standard industry practice, the gun subs 32, 34 operate on alternate polarities so they can be fired one after another. Those skilled in the art will recognize operation of the select fire aspects of the lowermost gun sub 34 to be conventional.

In one embodiment, the setting tool 12 may include several different sections or modules—a motor module 62 including a housing 64 having a dc motor 66 therein energized through a lead 68 comprising an extension of the circuit path 40 leaving the lowermost gun sub 34 and passing through the connector collar 44. The motor 66 may be of any suitable type and may preferably be a permanent magnet dc motor that generates its own magnetic field rather than a magnetic field induced by current flowing through the motor 66. The motor 66 may grounded through a connection 70 to the housing 64 and thus to the tool 12. The motor 66 is of a relatively small size because its power is limited by the operating voltage of the perforating gun 14 and allowable amperage of the switches 38, 52. Using the industry standard of 1.9 amps as the current that destroys the switches 38, 52, in one embodiment the setting tool 12 operates at an amperage of considerably less than 1.9 amps to provide a margin of safety, for example 1.6 amps. This limits the power capacity wattage of the motor 66 to the product of 1.6 amps and the operating voltage. The maximum operating voltage of industry standard perforating guns is 300-600 volts dc, meaning in one embodiment the setting tool 12 may operate at a lower voltage, for example, 200-400 dc volts. This dictates an example range of power capacity of the motor 66 to about 1.6×200=320 watts=0.45 horsepower to about 1.6×400=about 640 watts=0.9 horsepower. This is not a very large motor to produce the necessary tensile pull to set modern bridge plugs. The motor 66 may, of course, be a larger size, but the amount of power input to the motor 66 is dictated by the operating voltage and use of an amperage less than that which initiates or damages the perforating gun 14. The amount of tensile pull needed to be delivered by the tool 12 is a function of the diameter of the bridge plug 10. For example, for use inside 4½" casing, a tensile pull on the order of 15,000-25,000 pounds may be desired. For use inside 5½" casing, a tensile pull on the order of 40,000-60,000 pounds may be desired. In any event, larger diameter casing strings allow larger diameter motors, gear transmissions, and other components so the tensile pull requirements increase along with the capability of larger diameter tools 12.

In this embodiment, motor 66 includes an output shaft 72 drivably connected to an input shaft 74 of a gear box or transmission 76 including a housing 78 having one or more gears therein and an output 80. The gearing in the housing 78 may be of any suitable type and may comprise several gear trains in series. The gear ratio in the transmission 76 is sufficient to produce sufficient torque to set the bridge plug 10 within an acceptable time period and may typically be on the order of 80-200:1, depending on the characteristics of the motor 66 and the threads of the screw 82.

The output 80 of the transmission 76 connects to a screw 82 inside a housing 84 of a module 86. The screw 82 passes through a nut 88 connected by a sleeve 90 which, in turn, connects to the mandrel 30 of the bridge plug 10 through a section which is designed to pull in two upon the application of a predetermined tensile force. It will be seen that powering the motor 66 causes rotation of the output 80 of the transmission 76 thereby raising the nut 88, pulling on the mandrel 30 and thereby radially expanding the bridge plug 10 into sealing engagement with the casing 26. It will be seen that the overall gear reduction of the setting tool 12 includes the gear reduction in the transmission 76 and the characteristics of threads on the screw 82 and nut 88. In this embodiment, the rotational rate of the output 80, taken into account with the pitch of threads on the screw 82, is sufficient to set the bridge plug 10 in an acceptable time, e.g. in less than about one minute and which may preferably be considerably less such as in the range of 20-40 seconds. This favorably compares with the time to set slow burning ballistic setting tools, which are in the range of thirty seconds. A setting time of 20-60 seconds may be ideal because it is slow enough so the composite or plastic components of the bridge plug 10 are not compromised, but is fast enough to satisfy well owners and operators.

The stroke of the nut 88 is relatively modest and depends to some extent on the size and design of the bridge plug 10 and thus on the size and design of the tool 12. In a typical situation where the bridge plug 10 is designed to be run in conventional 4½" API casing, the stroke of the nut 88 may need to be only a few inches, e.g. less than one foot and may ideally be three to ten inches. In this embodiment, the number of revolutions of the screw 82 to advance the nut 88 only a few inches will be seen to be relatively few and can be achieved in a relatively short time period, even with the gear reduction provided by the transmission 76 and the screw 82.

Although the design parameters of the setting tool 12 may vary considerably, one successful design includes a permanent magnet dc motor of 1.5 horsepower, a gear transmission having a gear reduction of 115:1 and threads on the screw 82 having a 4 mm lead or roughly six threads per inch. This produces a situation where 721 revolutions of the motor shaft 72 produces one inch of travel of the nut 88.

Theoretically, rotation of the motor output 72, the gear box output 80, and the screw 82 could cause counter rotation of the exterior housing of the setting tool 12. However, this situation is not difficult to overcome because various means may be used to counteract this tendency. In one approach, the nut 88 may be square, hexagonal or otherwise flat sided and may travel in a square or rectilinear slot (not shown) inside the housing 84 to transfer torque to the housing 84 in the opposite direction of torque applied by the motor 66 and/or the gear transmission 76 to their housings 64, 78. It will be seen that torque in one direction applied to the housings 64, 78 is countered by the torque applied in the opposite direction to the housing 84 so there is no tendency of the tool 12 to rotate in use.

It will be apparent that the electrically operated setting tool 12 may be run to set and retrieve another settable well tool, such as a more-or-less conventional packer, such as a Baker Model R, inside a casing string where no perforating is involved. There are some situations when it is necessary or desirable to set a packer, conduct an operation above the packer, and then retrieve the packer, rather than the heretofore described operation where it is envisioned that the bridge plug 10 will be drilled up or allowed to dissolve. It will be seen that such a packer may be installed on the bottom of the tool 12 in the location of the bridge plug 10 so the packer can be set, some operation conducted and the packer then retrieved, while leaving the setting tool 12 in the well.

Referring to FIG. 4, another embodiment of an electrically powered setting tool 100 includes a connector collar 102 for connection to the lowermost gun sub of a select fire perforating gun, a sensing module 104, a motor module 106, a gear box module 108, a screw module 110 and a bridge plug 112. The module includes a housing 114 having an insulated circuit path 116 leading from the collar 102 to the lead 118 powering a dc electric motor 120 inside a housing of the motor module 106. The module housing 114 includes a pocket 122 receiving therein a recording implement 124 such as a battery powered memory tool of the type available from Omega Well Monitoring of Aberdeen, Scotland and Houston, Tex. The recording implement 124 may record a wide variety of information, including time, date, pressure, temperature and the like, at any suitable interval. Upon removal of the tool 100 from a well, the implement 124 may be retrieved and the information downloaded onto a suitable computer or suitable well information communication equipment may be used to transmit data acquired by the implement 124 to the surface location in real time.

Operation of the tool 16 should now be apparent. The tool 16 is assembled at the surface of a well location and lowered on the wireline 22 into the well 20, which may be vertical or have one or more horizontal legs, in which event the tool 16 is ultimately pumped into the horizontal section of the well 20. When the tool 16 reaches its desired location, the motor 66 is energized by delivering dc current of the correct polarity through the wireline 22, electric paths 54, 40 in the gun subs 32, 34 into the lead 68. Energization of the motor 66 causes gearing in the transmission 76 to rotate, thereby rotating the output 80 and raising the nut 88 which pulls the mandrel 30 upward. An element of the bridge plug 10 reacts against the bottom of the setting tool 12, and the pull of the mandrel causes the bridge plug to radially expand into sealing engagement with the casing 26. The bridge plug 10 may separate from the setting tool 12 in a conventional manner, as by pulling apart a neck carried by the sleeve 90.

Reversing the polarity of the dc current and delivering sufficient amperage causes the lowermost gun sub 34 to fire, thereby perforating a section of the casing 26 at the desired location. One effect of this is to produce a pressure pulse which activates the switch 52 thereby severing the electrical circuit to the gun sub 32 and arming the next adjacent sub 32. By reversing the polarity of the dc current applied to the gun 14, a long perforated interval may be achieved.

Figure 5:
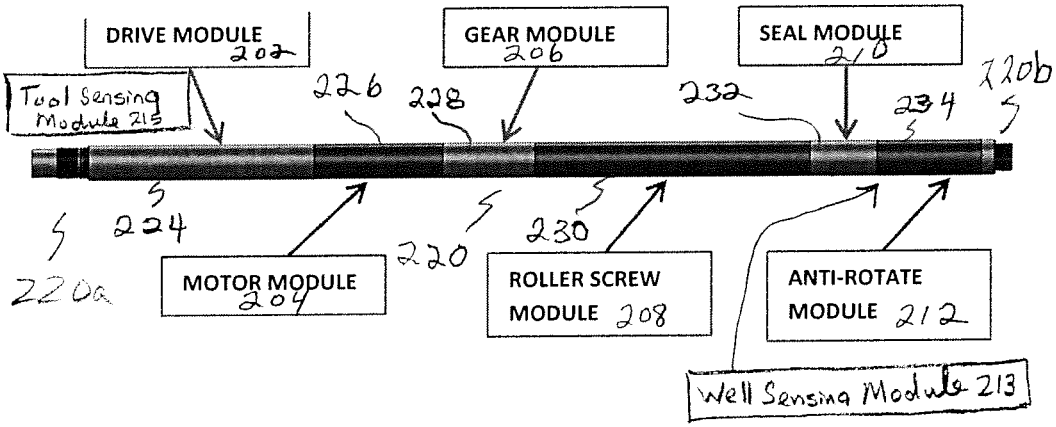
FIG. 5 is a side view of the housing of another example electric setting tool and how it is made up of a number of modules having modular housings.
Figures 6A, 6B:
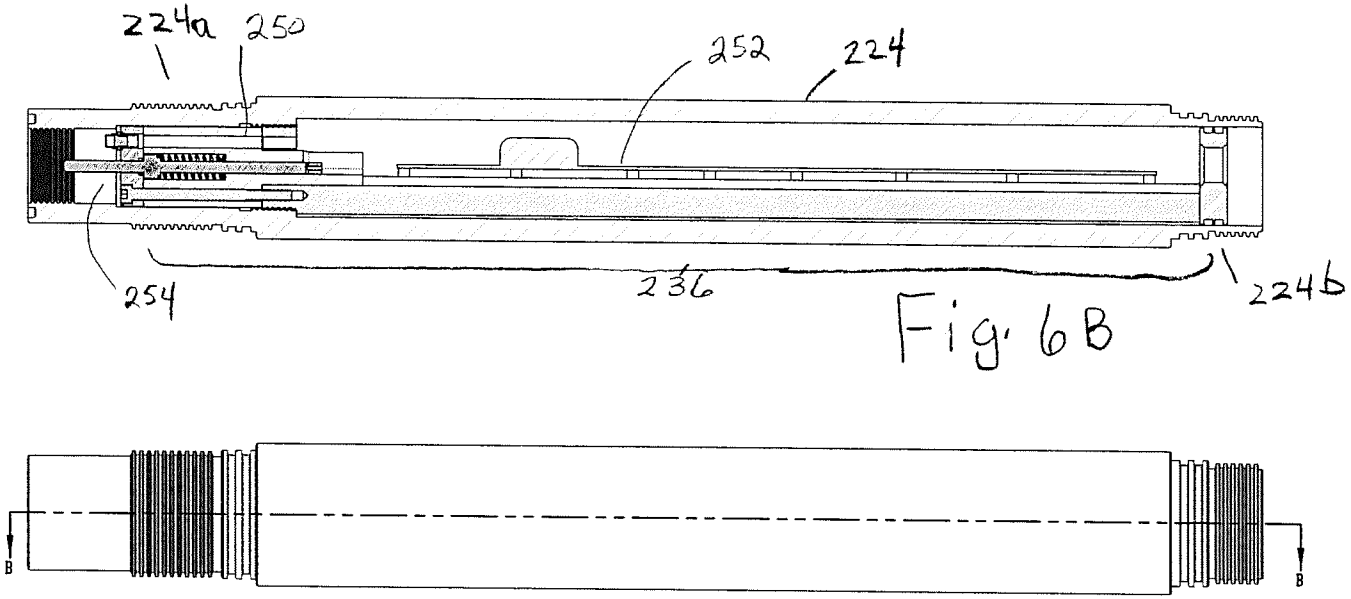
FIGS. 6A-6E illustrate various views of the drive module of the electric setting tool.
Figure 6C:
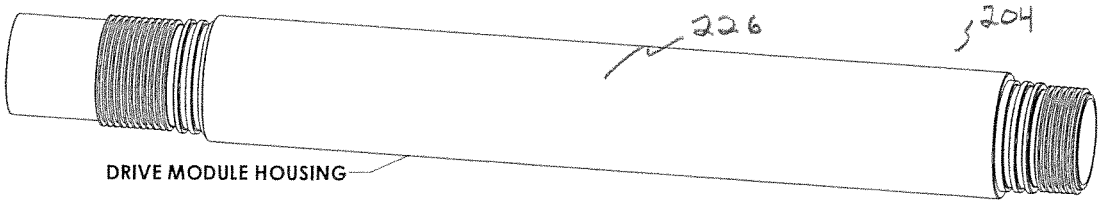
Figure 6D:
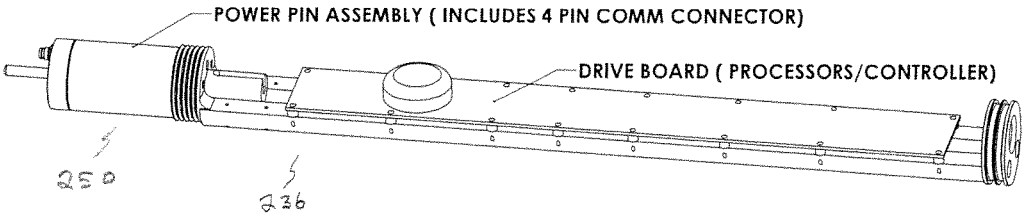
Figure 6E:
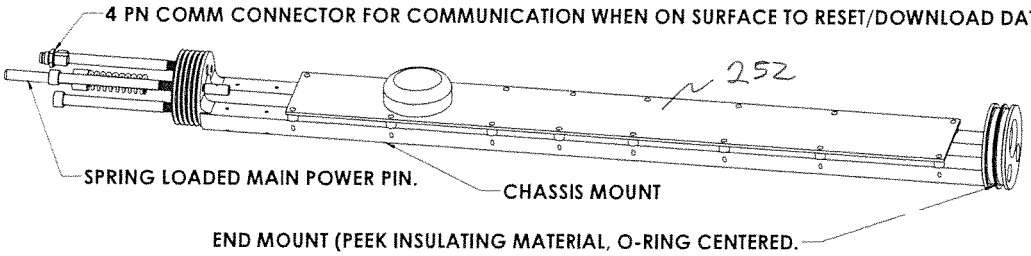

FIG. 5 illustrates another example embodiment 200 of an electric setting tool. Electric (or downhole) setting tool 200 as seen in FIG. 5 may, in one embodiment, be modular in nature, having at least some of the following modules threadably or otherwise coupled to one another, the modules differing from adjacent modules functionally and structurally. In other embodiments, the electric setting tool may not be modular.

Left to right (uphole to downhole) in FIG. 5 are the following: drive module 202, motor module 204, gear module 206, roller screw module 208, seal module 210, and anti-rotation module 212. Drive module 202 generally comprises electronic elements and processor elements for handling communications, control, and current between the wellhead and elements, including those downhole from the drive module as set forth in more detail below, see FIGS. 6A-6E. Motor module 204 (see FIGS. 7A-7G), with a d.c. motor assembly 238 including d.c. motor 214 receives electrical energy from drive module 202 to output rotational motion to transmission or gear module 206. Gear module 206 (see FIGS. 8A-8H) provides a geared reduction rotary output to a roller screw module 208 or other suitable linear anchor, see FIGS. 9A-9I. Roller screw module 208 converts rotary motor input from gear module 206 to linear motion output, the gear module, and the roller screw module, forming a transmission assembly. Seal module 210 (see FIGS. 10A-10D) provides dynamic sealing to prevent downhole fluid from entering the housing uphole thereof. Anti-rotation module 212 (see FIGS. 11A-11E) transmits linear motion and prevents rotation for elements required to set a settable tool, see FIG. 12A, through engagement of the electric setting tool to a settable tool 216 (such as a bridge plug or packer, for example) is achieved by adapter assembly 400, see FIG. 12A-12B ("adapter assembly").

Thus, functionally, the electric setting tool 200 achieves, from an electrical input, generation of a linear motion output with respect to an electric setting tool housing assembly 220, having a multi-element static fluid seal 426/428/43 (see FIG. 12B) at uphole end 220*a* and a downhole end 220*b*, at or near where a dynamic seal is located (see FIG. 5). Uphole end 220*a* may be attached to perf gun subs or wireline 22 and downhole end 220*b* is attached to adapter assembly 218, see FIG. 12A. The separate functions required to convert and control electrical energy input to controlled linear motion output may, in one embodiment, be provided in separate modules, with separate engageable housings: drive module housing 224; motor module housing 226; gear module housing 228; roller screw modular housing 230; seal module housing 232 and optionally anti-rotation module housing 234.

Drive module housing 224 as seen in FIGS. 6A-6E houses an electronics assembly 236 for receiving, processing, and outputting electric signals and current as more specifically set forth below, sealed from downhole fluids as more specifically set forth below, and housing 224 for threadably coupling (or other suitable releasable coupling) to a wireline or perf gun sub or other suitable device or assembly on an uphole end 224*a* of housing 224 and at a downhole housing end 224*b* to a motor module uphole end 226*a*. A static seal is provided by the O-rings on the outer grooves of the drive module, the O-ring in the end face groove on the very end of the drive module, and the quick change sub that screws onto the top side of the drive module. This cross over tool or quick change sub 420 (see FIG. 12B) is, in one embodiment, between the bottom of the perf gun and the top side of the drive module. On additional implementations of this tool, the top side of the drive module may in fact be sealed to bore fluid pressure.

FIGS. 6A-6E illustrate the drive module containing the electronics control assembly 236. Electronics control assembly 236 may include a switch (e.g., one or more diodes), which allows negative voltage to trigger a perf gun, such as perf gun 14, while preventing damage to electric setting tool 200. A current limiter or regulator is part of the processor controller and insures that the 2.0 amp current limit not exceeded. A process controller 1510 is provided to monitor the current and determines operational conditions based on voltage present. A motor controller 1520 is provided that maximizes commands from the process controller to minimize set time given the voltage present downhole (see also FIGS. 13-15). Power pin assembly 250 is provided for connecting current to a drive board 252, and may include a 4 pin com connector 254.

When voltage greater than about 300 volts dc is applied, process controller 1510 enters "auto" mode and starts a 5-second delay before any motion is commanded. After the initial 5-second delay, the process controller will command motor controller 1020 to retract tool 216 to full stroke. When full stroke is complete, the controller will remain static and command no further motion. If the current limit is reached, the process controller will stop the motion and attempt five restarts (one in one embodiment; in another, one or more) to reach completion.

FIGS. 7A-7F show motor module 204 has housing 226 for enclosing and protecting d.c. motor drive assembly 238, housing having an uphole end 226*a* and a downhole end 226*b*. D.C. motor drive assembly 238 is provided for receiving output from the electronics control assembly and converting the output to rotary motion and includes, in one embodiment, d.c. motor 214, which may be a frameless, brushless (BLDC) d.c. motor, 600 volts maximum. D.C. motor 214 includes stator coils 214*a* and rotor assembly 214*b* comprising a motor shaft 215 with a pressed on permanent magnet containing rotor 221. Resolver assembly 256, including resolver housing 261, may locate the motor and bearing sets 258 and provide rotor position feedback to the drive module. Threaded lock ring nut 260 contacts uphole end of resolver housing 261 and holds assembly 256 in place. Connector cap 262 (may be made from PEEK or other suitable material) engages resolver assembly 256 and acts as a heat insulating cap and to protect motor/revolver wires from shaft. Resolver 264 is mounted on resolver bearing 266. Resolver 264 engages rotor assembly 214*b* to provide position feedback to the drive module. Rotor 214*b* may be keyed to a motor output shaft 268, which may have arms 268*a* and 268*b*. Bearings 269 support rotor assembly 214*b* to housing 224. One such BLDC rotor and stator is available from Kollmorgem, Model HP/HT, Rochester, N.Y. (USA). One resolver that may be used is a Harowe Resolver available from Dynapar, capable of operating in high temperatures/high pressure environments.

Kollmorgen is a Danaher Corporation company. The motor is a version of a MIL Spec motor they manufacture for the military, high shock, high temp, etc. The rotor has a unique three-step bore (see FIG. 7 G-J) that requires less distance under force to press onto the motor shaft. The permanent magnets are constrained in a very thin, swaged on metal sleeve 219 (see FIG. 7H), rather than constrained with epoxy to handle the high temps. The motor controller 1520 is part of drive board 236*a* of the electronics assembly 236 in drive module 202. The motor and resolver may have leads into the drive module. The drive and motor modules, motor and drive, may be sealed on each end so, regardless of a leak, they will not be damaged. This may include the gear box module as well. It is easier to seal a 35 rpm shaft to 10,000 psi verses a 4100 rpm shaft. HP/HT (high pressure, high temperature) connectors from Kemlon (or any other suitable HT/HP connector) may be used for any cable or lead connections. For further details on suitable motors see: http://www.vickers-warnick.com/news/how-new-kollmorgen-hpht-downhole-electric-motors-help-the-oil-industry/.

Figures 7A, 7B:
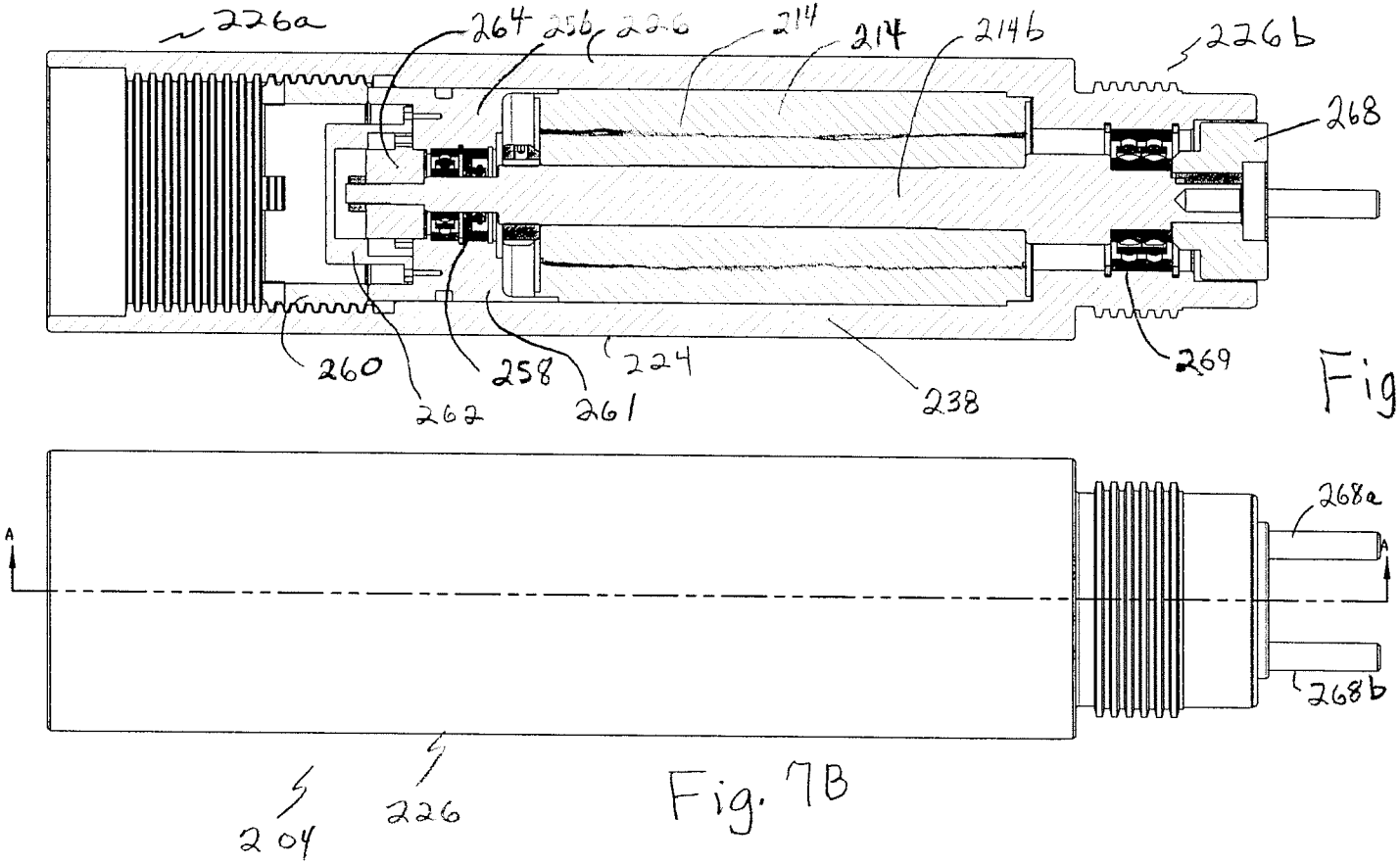
FIGS. 7A-7J illustrate various views of the motor module and parts thereof of the electric setting tool.
Figures 7C, 7D, 7E, 7F, 7G:
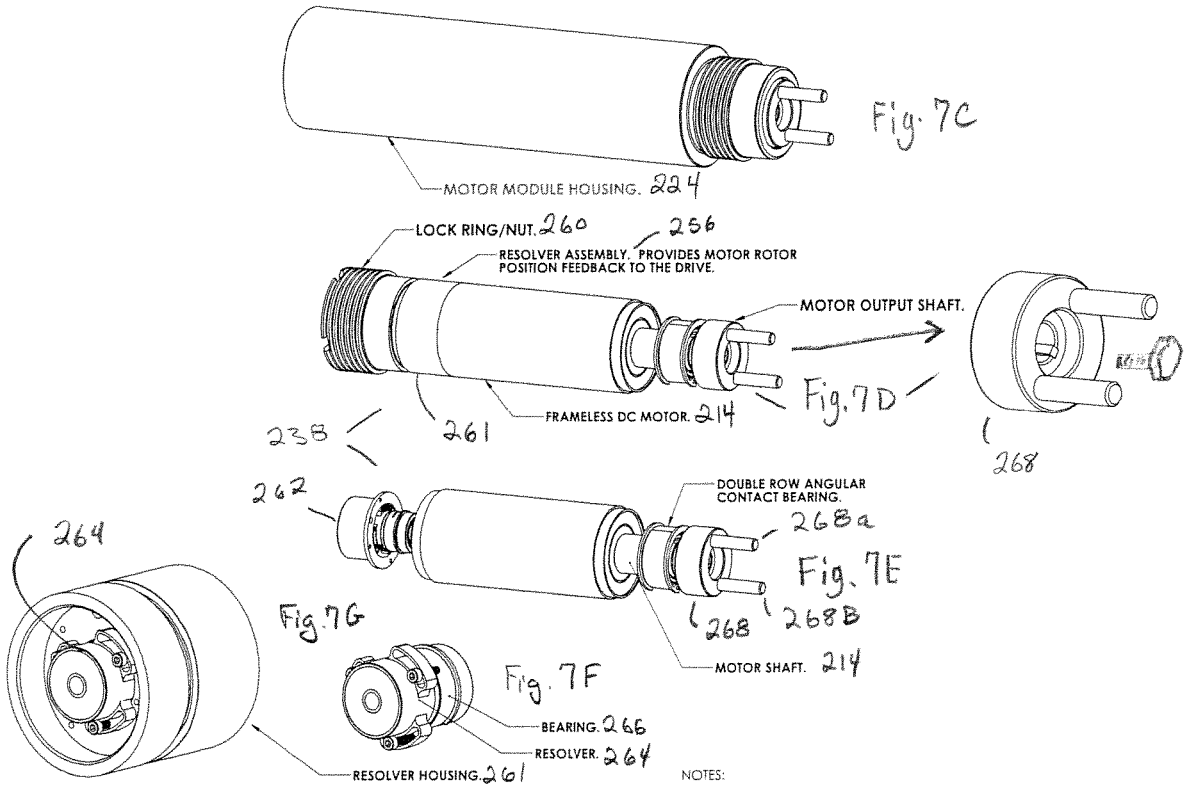
Figures 7G, 7H, 7I, 7J:
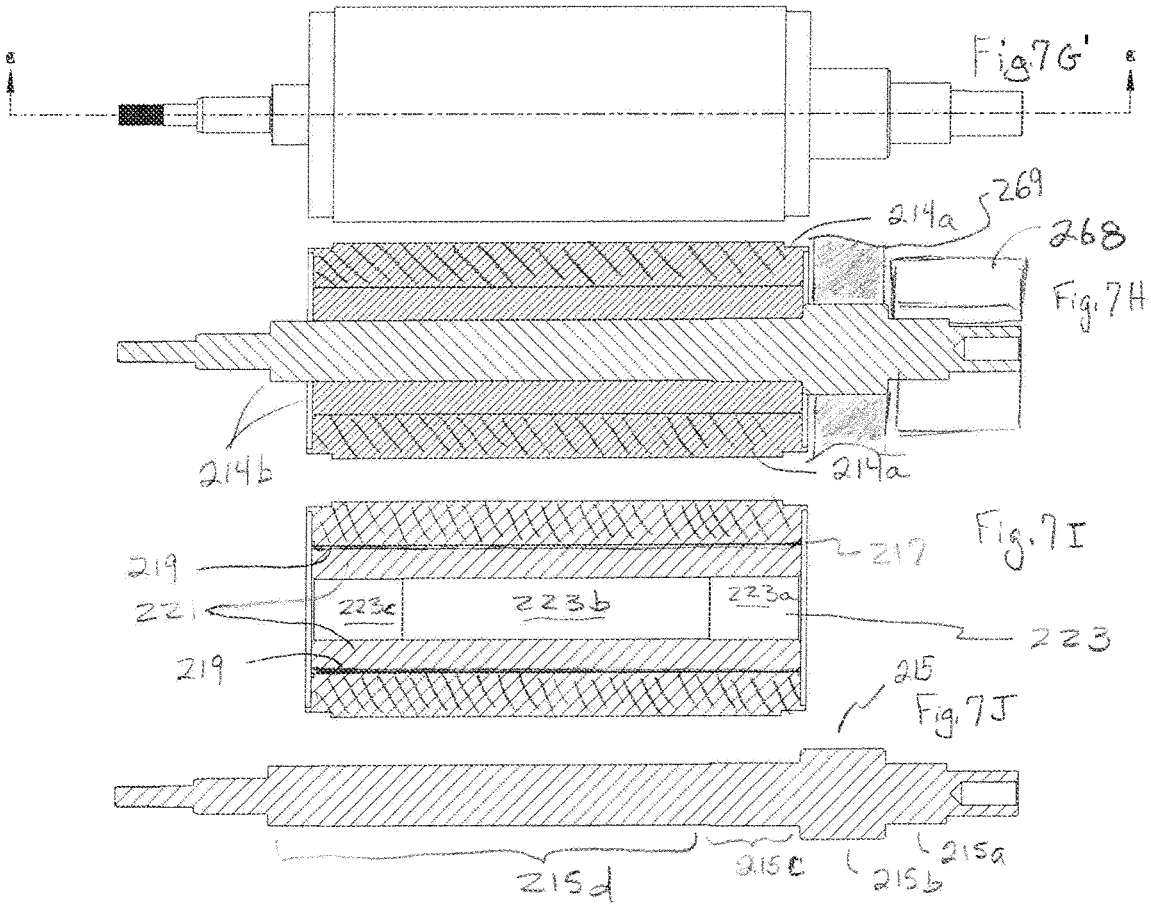
Figures 8A, 8B:
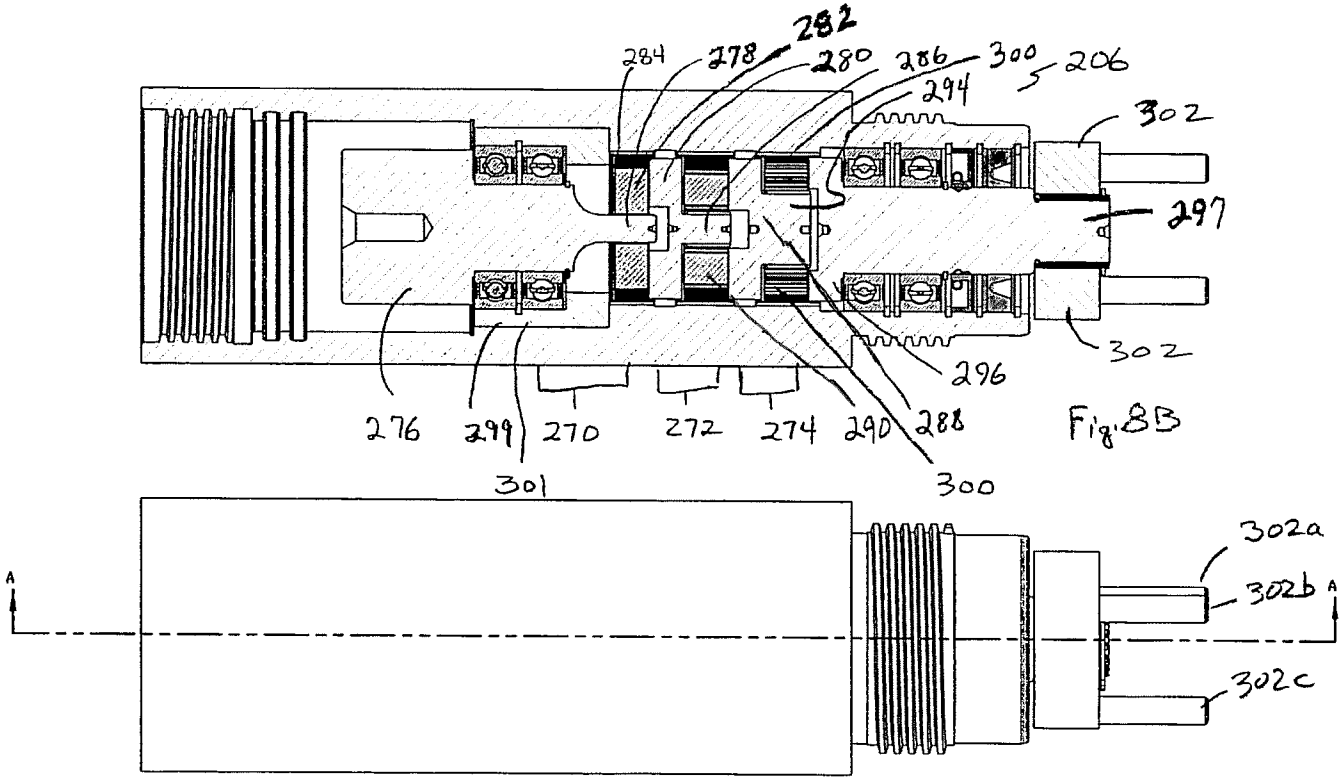
FIGS. 8A-8H illustrate various views of the gear module and parts thereof of the electric setting tool.
Figure 8C:
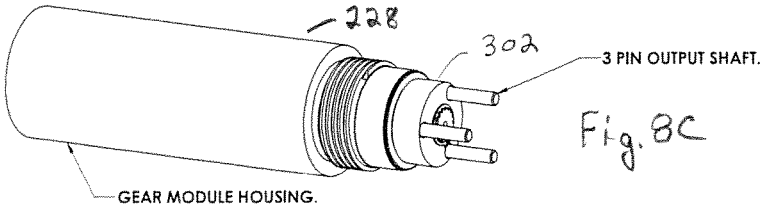
Figure 8E:
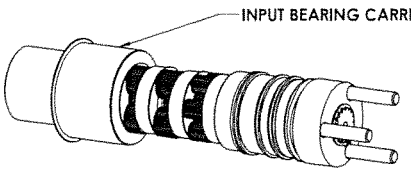
Figure 8D:
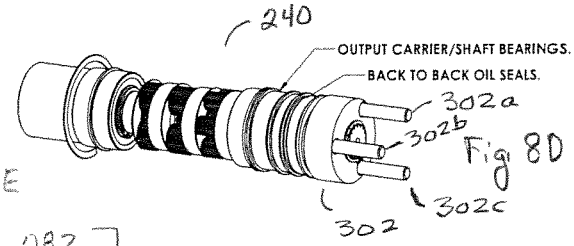
Figure 8F:
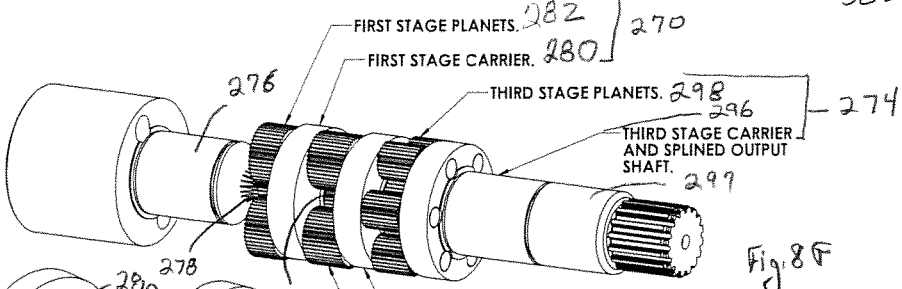
Figure 8H:
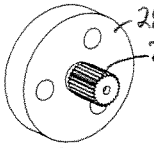
Figure 8G:
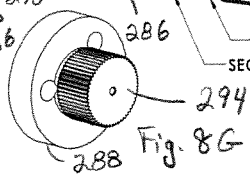

FIGS. 7G-7J illustrate further details of the DC motor 214, having Stator coils 214*a* and rotor assembly 214*b*. Rotor assembly 214*b* is seen to comprise a motor shaft 215 with, in one embodiment, a pressed on rotor 221, which rotor contains the permanent magnets. Motor shaft 215 is seen to have a number of sections differing one from the other in diameter. Right to left as seen in FIG. 7J: section 215*a* is dimensioned to receive motor output shaft 268. The greatest OD is seen on section 215*b* which seats bearing 269 from the shaft to the inner walls of the motor module housing. Between sections 215*d* and 215*b* is a section slightly larger in diameter than section 215*d*, section 215*c*. Turning now to rotor 221, bore 223 is seen to have three sections: 223*a* for an interference fit against section 215*c* when the rotor is pressed on to the motor shaft. Section 223*b* is designed for clearance fit to section 215*d* of the motor shaft. Section 223*c* of the bore is slightly smaller in diameter than section 215*d* of the shaft and is adapted for an interference fit with section 215*d*. Thus, when rotor 221 is pressed on to the motor shaft 215 as seen in FIG. 7H an interference fit will start just as the rightmost end of rotor 221 reaches the boundary between sections 215*d* and slightly larger 215*c*. In one embodiment, bore section 223*a* has a diameter of 0.680" (clearance fit) and section 223*c* 0.670" (interference fit to motor shaft). At this point, section 223*c* will just be encountering the leftmost end of section 215*d*. The purpose of the 'stepped bore' 223 is to ease the fitting of the motor shaft to the rotor. It requires less distance under force. Another feature is a rotor shell 219 that is swagged onto the outer cylindrical surface of the magnets to help hold them in place comprising in part rotor 221, which shell 219 is protective so that should any of the magnets crumble or disintegrate they would not scatter or otherwise impede rotation of rotor assembly 214*b*. A small air gap 217 may be provided between the outer surface of rotor shell 219 and the inner surface of stator coils 214*a*.

FIGS. 8A-8F show gear module 206 has a gear module housing 228, which has an uphole end 228*a* and a downhole end 228*b*, and which houses, in one embodiment, a gear assembly 240 which receives and reduces the rotary motion output of the motor drive assembly 238.

Gear assembly 240 may include three planetary gear assemblies: first 270, second 272, and third 274. First planetary gear assembly 270 includes input shaft 276 having a sun gear 278 on a removed end thereof. A carrier assembly comprising carrier 280 and rotationally mounted planet gears (typically three) 282 allow planet gears to mesh with sun gear 278 (inner mesh) and a stationary ring gear 284 (outer mesh), which may be a machined insert or teeth machined on the inner walls of housing 228. Second planetary gear assembly 272 may include a sun gear 286 mounted on the shaft of carrier 280 and driven by first stage carrier 280. Second carrier 288 includes second planetary gears 290 (typically three), which mesh with ring gear 292 which may be a machined insert or teeth machined into the inner surface of housing 228. Third planetary gear assembly 274 includes a sun gear 294 mounted to the shaft of second carrier 288, and a third carrier 296 carrying planet gears 298 (typically three) which mesh with ring gear 300, which may be a machined insert or may be teeth machined into the inner walls of housing 228. Shaft 297 is a longitudinal arm or extension of carrier 296 and splined to transfer rotary motion to output shaft 302. It is seen that the sun gears are input, the planet gears/carrier are output and the three ring gears, internally toothed, are stationary. An input bearing carrier 299 may locate input shaft bearings 301.

Progressively, it is seen that the sun gears get larger, left to right (FIG. 8B) and planetary gears smaller in radius while the radii of the ring gears may represent the I.D. of the gear module housing. In a preferred embodiment, geared reduction, input at sun gear 278 to output at third carrier 296 is 115.5:1 or in the range of 60:1 to 165:1 in one range, 30:1 to 350:1 in a second range. Output shaft 302 may include arms 302*a*/302*b*/302*c*, and may be splined to shaft 297 of third carrier 296.

Bottom hole pressure is trying to force the polished rod into the tool as inside the tool the pressure is lower due to the seals. The gear assembly acts as a brake against this 'back strolling' force, which tries to pre-set the plug.

FIGS. 9A-9I show roller screw module 208 includes roller screw housing 230 which has an uphole end 230*a* and a downhole end 230*b* and houses a roller screw assembly 242 which includes a polished rod 244, which roller screw assembly receives the rotary motion output from the gear assembly 240 and converts it to linear motion carried by the polished rod. The roller screw assembly 242 includes input collar 306 having inner face 306*a* for receiving arms 302*a, b*, and *c* from output shaft 302. Moving nut 310 with inner threads threadably engages uphole end of polished rod 244 with mounting outer threads to move it up when the motor 214 is energized. Roller screw moving nut 310 is driven by threaded shaft 308 having uphole splined end 322 for receiving splined input disk 306. In one embodiment, the assembly provides about 0.157" per revolution on a 4" lead.

Thrust bearing unit 314 must handle high loads during stroke operation. One such high thrust bearing unit is available from CMC, Bellevue, Wash., and may be found in US Patent Publication No. 2014/0301686, incorporated herein by reference. Housing internal shoulder 316 receives one end of the thrust bearing unit and circumferential ridge 318 at the uphole end of roller screw 308 engaging a keeper assembly 320 for locating and transmitting compressive loads to thrust bearing. Splined end 322 slideably engages splined inner walls of input disc or collar 306. Keeper assembly 320 receives an inner face 306*a* of input disc 306 and transmits high compressive loads to uphole face of thrust bearing unit 314 without shearing on a small diameter shaft such as a 20 mm shaft or one less than about 30 mm. The inner face of the keeper sections 321*a*/321*b*/321*c* abut the inner race 314*a* of thrust bearing 314 (see '686 publication).

Figures 9A, 9B:
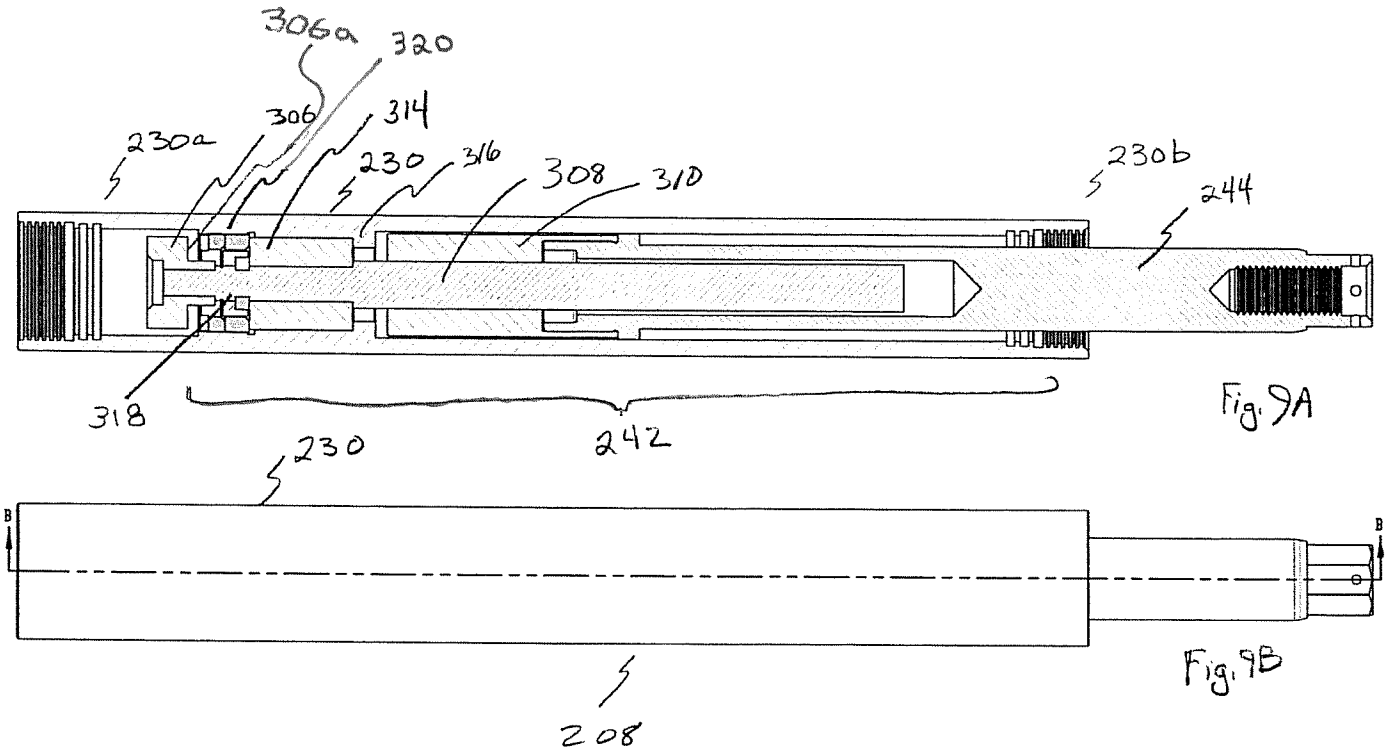
FIGS. 9A-9I illustrate various views of the roller screw module and parts thereof of the electric setting tool.
Figures 9C, 9D, 9E, 9F:
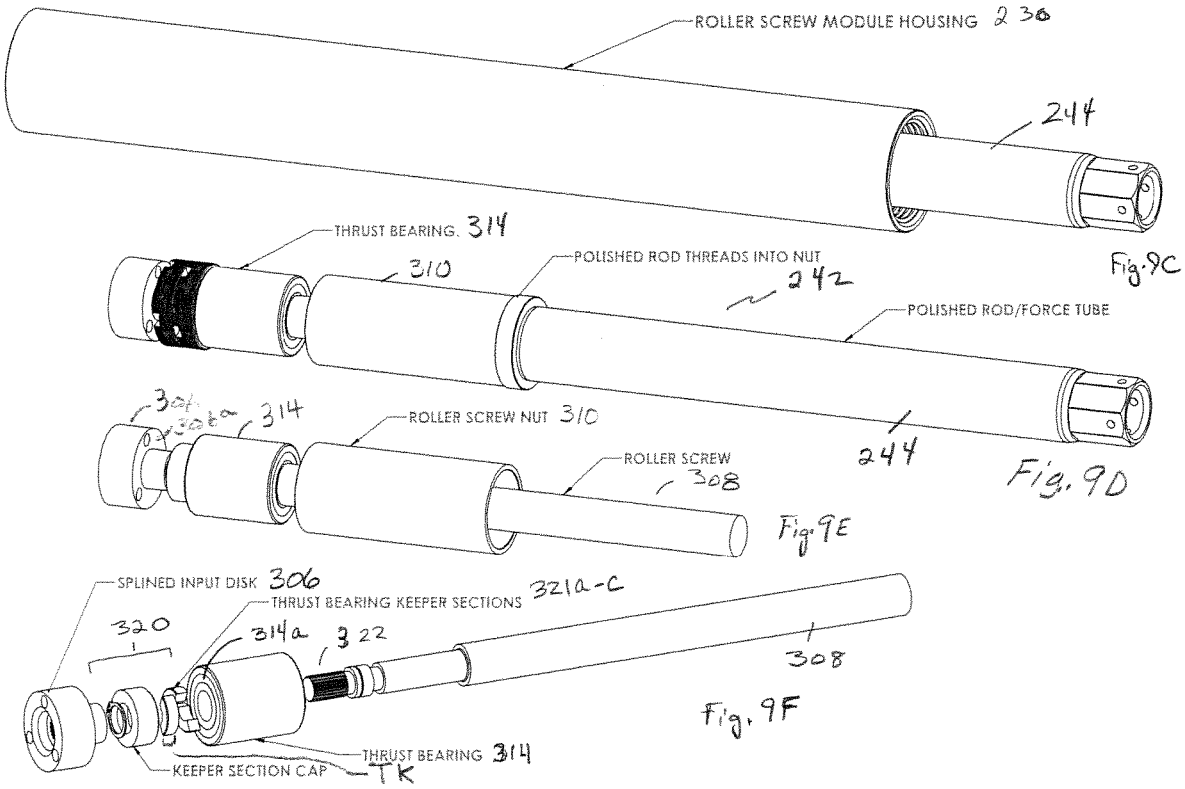
Figures 9G, 9H, 9I:
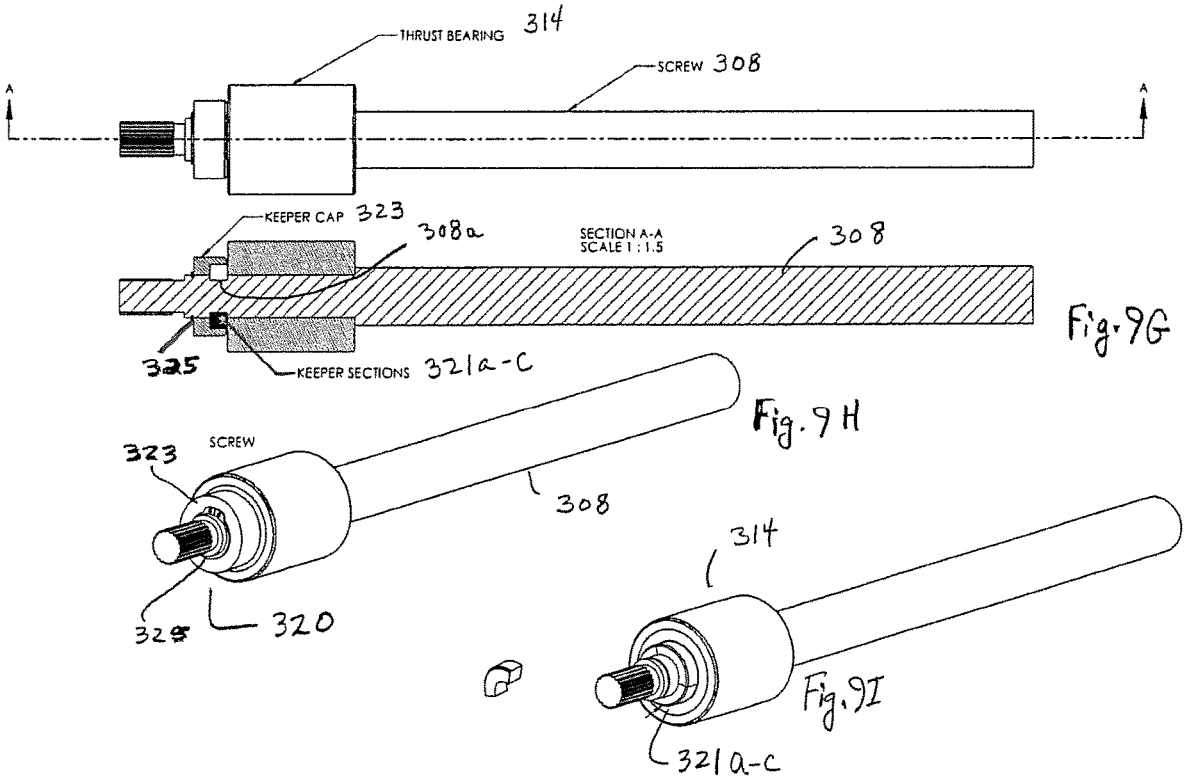
Figures 10A, 10B:
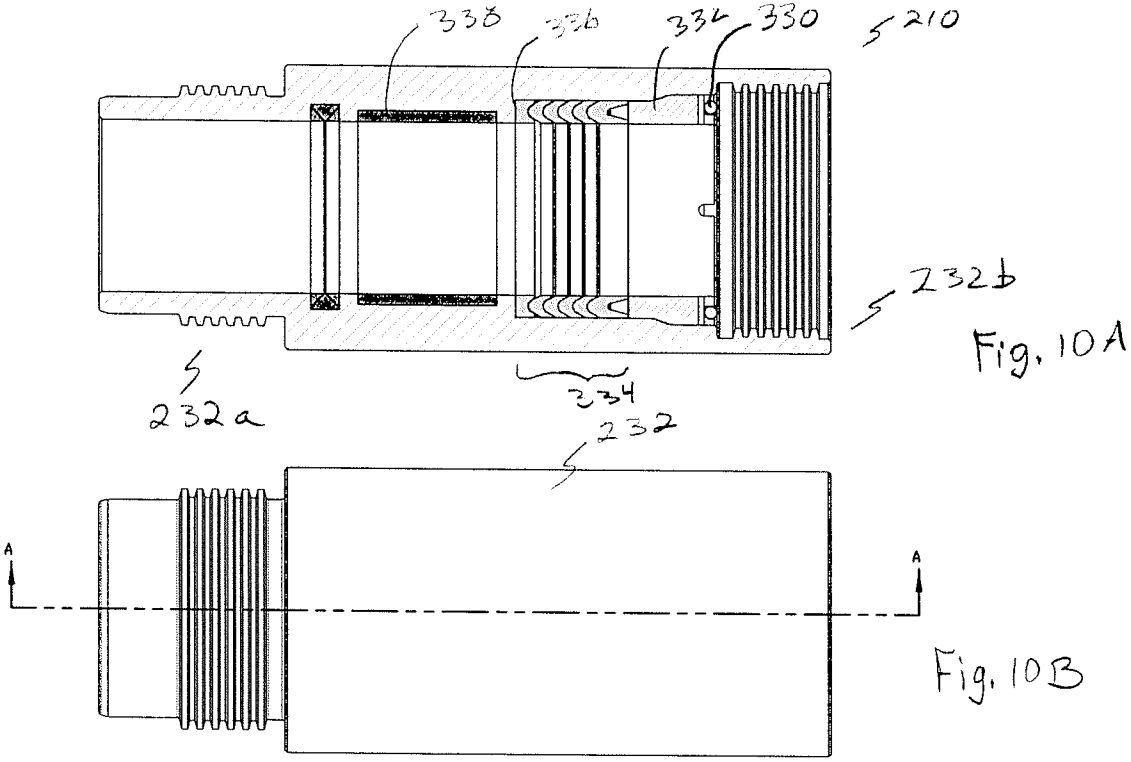
FIGS. 10A-10D illustrate various views of the seal module of the electric setting tool.
Figure 10C:
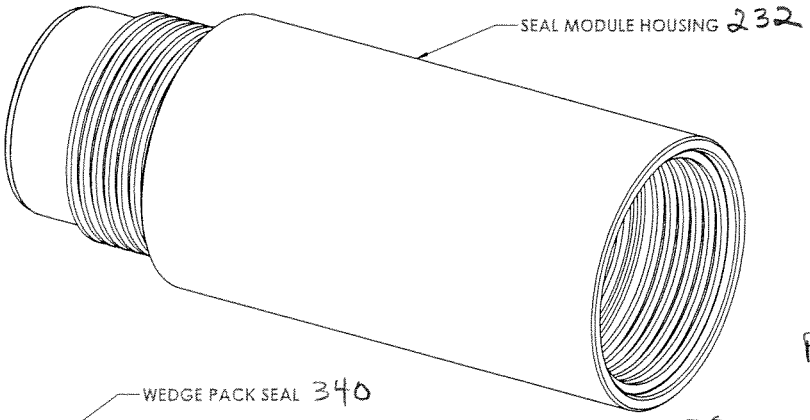
Figure 10D:
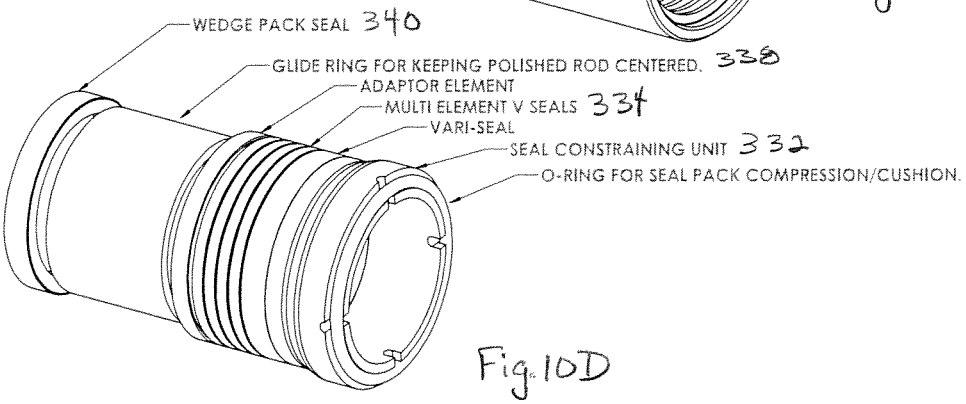
Figure 11A:
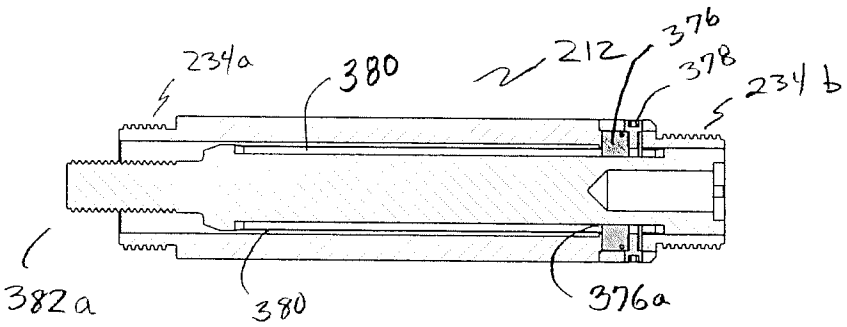
Figure 11B:
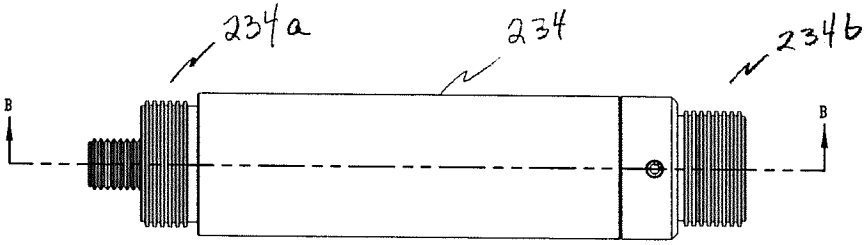

As seen in FIGS. 9F-9I, there are three keeper sections 321*a*/321*b*/321*c* to the keeper assembly that fit in the machined groove 308*a* (about 15 mm in diameter) and make up a 360° retainer, a cap 323 and (optional) ring 325 help keep the sections in place. Keeper cap 323 provides an interference fit—stability to keepers so they do not "tilt" out of groove 308*a*, as may happen with retainer rings under high loads. The keeper sections can be manufactured to the thickness and width needed to handle the shear force of the thrust load with this being a 20 mm diameter shaft (15 mm od at groove 308*a*). There are no commercially available retaining rings that will safely handle a 25,000 lb. load. In one embodiment, keeper sections are about 8-10 mm thick. Threaded nuts are not an option here either. Most with this diameter are rated for around 6,000-10,000 lbs. when using 2× safety factor. Multiple thick keepers are important for higher force tools that may see a thrust load here of 50,000 lbs. or more. The thickness of the sections may be in the range of 5 to 12 mm or more to handle these forces. Thickness is seen in FIG. 9F "Tk". Keeper sections may be heat treated alloy 17-4p HT at 1050 or better to provide hardness to withstand high shear without failing. These keeper sections, constrained by the cap, will not back out like a threaded nut or turn/open like a snap/retainer ring when subjected to a high shear load.

The basic formula for determining shear strength of retaining rings/elements is:

$$PR=B*T*Ss*3.1416/K$$

Pr=shear strength
B=the diameter of the bore or shaft
T=overall thickness of retaining element
Ss=shear strength of retaining element material
K=safety factor
The 25 k tools shaft is about 20 mm or 0.7874".
The thickness of the keeper section is 8 mm or 0.315 or between about 5 mm and 12 mm.
The material has a yield strength of about 170,000 pounds.
Safety factor used is 2×.

This gives these keeper sections (17-4 pH in H900, 0.315") a 66223 lb. shear rating @2× safety factor. Any material may be used to insure sufficient shear load capability. This is also dependent on the threaded screw material as well, which when heat treated may exceed the material hardness of the keepers. The actual groove diameter and width may be dimensioned to accommodate the anticipated load.

FIGS. 10A-10D illustrate details of the seal module 212 illustrating the dynamic multi-element seal assembly for sealing between polished rod 244 and housing while preventing downhole fluid from passing, even under high pressures of a downhole environment. Seal module 210 includes seal module housing 232 which has up hole end 232*a* and downhole end 232*b* and houses a dynamic seal assembly 246 for engaging the polished rod and seal module housing 232 to prevent the passage of fluid past the dynamic seal of the seal assembly. In a preferred embodiment, the dynamic seal is the only dynamic seal on the electric setting tool. Multiple grooves are machined into the inner walls of module housing 232. An "O" ring 330 lays adjacent a seal constraining gland nut 332. A multi-element "V" seal assembly 334 uphole of seal constraining ring 332 has multiple (in one case more than three) V-seals or chevron shaped seals with their openings facing down-hole (pressure will force legs into the polished rod) provide sealed contact with the outer surface of polished rod 244. An adapter element 336 may be provided for locating one end of the seal assembly 334 to inner walls of module. A glide ring 338 in one embodiment PTFE will help center the rod in the housing. A wedge pack seal 340 will help prevent the passage of any fluids that may find their way past down hole elements of the seal assembly.

Figure 12A:
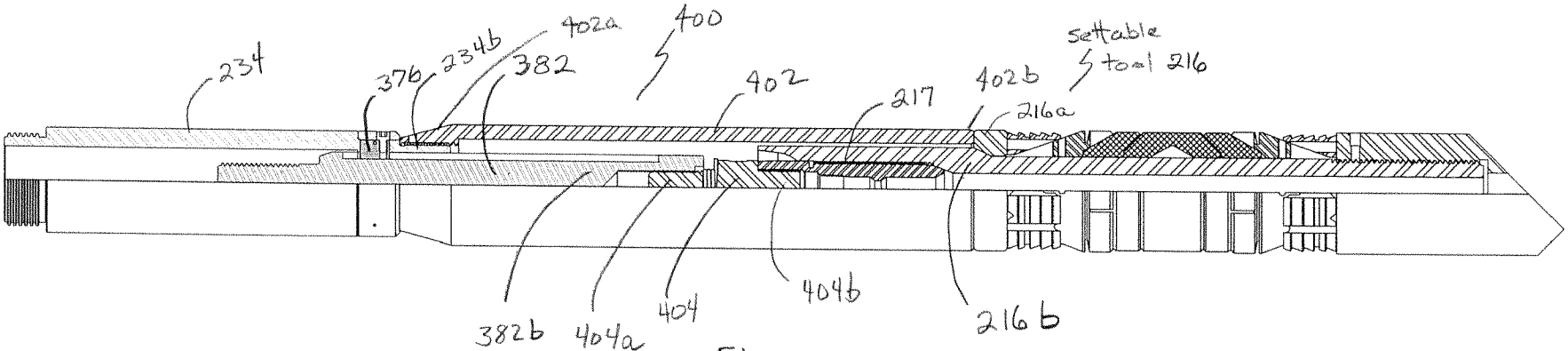
FIG. 12A illustrates a side cutaway/external view of an adapter tool for adapting an electric setting tool to a settable tool for setting downhole.

As seen in FIGS. 11A-11E, anti-rotation module 212 includes a housing 234, uphole end 234*a*, and downhole end 234*b*, and houses an anti-rotation assembly 248 which engages the polished rod 244 to prevent rotation, the anti-rotation assembly 248 for engaging adapter assembly 400 as seen in FIG. 12A. One end of housing 234 may include a sleeve 370 to fit a stepped down section 372, which includes a key cutout 374. One or more anti-rotation key(s) 376 are fastened to sleeve 370 with fastener 378. Key 376 has removed end 376*a* that extends into groove 380 of anti-rotate shaft 382, preventing rotation of the housing. Key 376 has a height that includes about the depth of the groove and the thickness of sleeve 370, which sleeve has a hole to receive fastener 378, this provides a key assembly that allows replacement of a warm key without removal of shaft 382 from housing 234. Threaded uphole end 382 allows threaded coupling to the downhole end of polished rod 244 (see FIG. 9A).

Anti-rotation assembly 248 is designed so that when the plug adapter sleeve is attached, the fasteners 378 can actually be completely removed and the keys 376 will remain in the slots. The keys are also drilled and tapped, the actual sleeve is not. If and when this tool is rebuilt in the shop, you may have a new set of threads by installing a new set of keys.

By using a pin-in-hole setup from the roller screw to the gearbox (see FIG. 8D arms 302*a*/302*b*/302*c* for receipt into holes of input disk 306, FIG. 9E) or the gearbox output shaft to motor (see FIG. 7E and FIG. 8F for pin/hole connection), there is no shock transmitted linearly from the roller screw to the gearbox or the gearbox to the motor. These pins float axially in the input disc bores.

FIG. 12A illustrates use of adapter 400 comprising a setting sleeve 402 and an adapter rod 404. Adapter rod 404 has an uphole end 404*a* to engage downhole end of anti-rotation shaft 382*b*. downhole end 404*b* engages shear sub 217 (part of settable tool 216) which, in one embodiment, may shear at above 15,000 lbs. after setting slips and sealing elements. FIG. 12A shows uphole end 402*a* of sleeve engaging downhole end 234*b* of anti-rotation module housing 234. Downhole end 402*b* contacts upper collar 216*a* of settable tool, and holds it in place while upstroke of the polished rod/anti-rotation shaft/adapter rod pulls up on the mandrel 216*b* of settable tool 216. Settable tool may be any tool in which a mandrel or other central support member moves relative to other elements of the tool.

In a preferred embodiment, the ends of most of the modules threadably couple one to the other and have "O" rings or other suitable seals to prevent fluid from passing into the housings through their engagement locations. The uphole end of the drive module is statically sealed and the downhole end of the anti-rotation module attached to the adapter assembly.

The tool may record and/or transmit to the surface (real time) well environmental conditions (time, temperature, pressure) with an optional well sensing module 213 which may, in one embodiment, be located downhole of the seal module, in another embodiment, be within the sealed portion of the housing (for example, the drive module) with internal and/or external sensors, and, in another embodiment, be located uphole of the motor module. This data may be recorded while traversing the well, during setting, and after setting (e.g., during fracing). The pressure and temperature data may provide feedback regarding setting tool and well tool operations (e.g., operating ranges and failures). The tool may also record and/or transmit (real time), tool condition information such as stroke position, current draw, motor restarts, and input voltage. This sensor/record/transmit assembly may be part of a tool sensing module 213 which may be in or part of or engaged with drive module 202. In one embodiment, a position sensor is embedded in roller screw to help determine stroke position. In general, the well/tool monitoring, sensing, recording, and transmitting operations may occur in one or more modules on, in, above, or below the tool.

Sensing module 213 may, for example, measure pressure, temperature, and/or time. Sensing module 213 may use electric (e.g., thermocouple), electronic (e.g., crystal sensing), or other techniques to measure temperature. Sensing module 213 may use piezoresistive, capacitance, electromagnetic, or piezoelectric techniques to sense pressure. The sensor may, for example, be a pressure and temperature micro-recorder, available from Openfield Technology of Versailles, Island of France (France).

The efficiency of the gear assembly and roller screw assembly may be high, typically above about 90%. While planetary gears are shown, gear reduction may be achieved by a magnetic gearbox, hydraulic gears driving multi-stage pumps, harmonic gearing, or other suitable gearing.

The efficiency of the drive train (motor assembly, gear assembly, linear actuator) may be achieved in three areas, the motor, the gearing and roller screw. The windings in the motor are specifically wound to make maximum use of the available voltage and current. Other linear actuators and other screw mechanisms may be used. The roller screw will generate huge forces in small packages with a long life. A roller screw linear actuator will be in the about 82% to 85% efficiency range. A ball screw may get this efficiency or more efficiency. The efficiency of a ball screw may be so high that back driving has to be dealt with. There are several ways to deal with this such as a "power off" brake on the motor. A single direction bearing between the gear box output and roller screw input may also be used. A lead screw and nut may also be used but may be less efficient. This may require an increase in the gearing and the tool may take longer to set.

A ball screw may be used but may have some drawbacks for the high load applications. In order to build a ball screw that can handle the 25 k loads, the lead should be 5 mm or more which means less gearing effect from the screw but the increase in efficiency more than offsets this lead increase. Lead is the axial travel of the nut when the screw is turned one revolution, so a 5 mm lead would move 5 mm in one turn. The current 25 k tool, in one embodiment, uses about a 4 mm lead. A 2 mm lead 50 k screw means that you now only need one power head to run a 25 k or a 50 k bottom end, no change in gearing is needed. It also means an increase in lead on that screw size would increase capacity. Thus, one might have a 3⅝" tool with more gearing that could handle more than 50K.

Figure 12B:
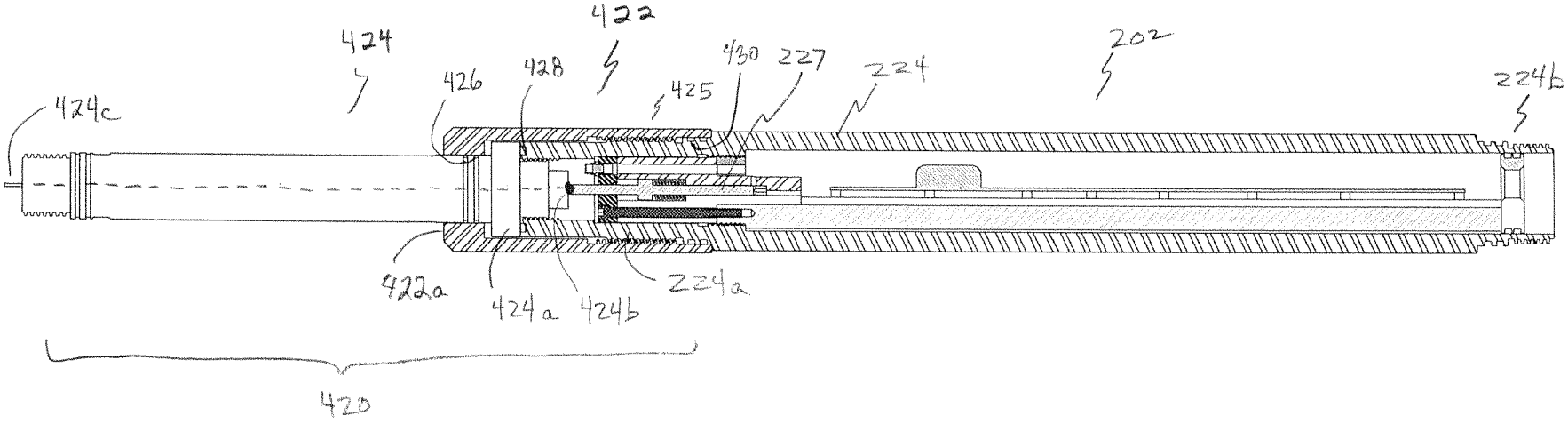
FIG. 12B illustrates a quick change sub for engaging an electric setting tool to a wireline.

FIG. 12B illustrates the use of a quick change sub 420 to connect electric setting tool 200 to an uphole perf gun sub. There are at least two parts to the quick change sub, a collar 422 for engaging an uphole end 224*a* of drive module housing 224 of drive module 202. A conductor rod 242 is captured with the downhole end against the upper end of the drive module for electrically conductive contact therewith. Collar 422 may have a cap 422*a* for enclosing a land 424*a* on the lower end of the rod to squeeze it against the upper end of the drive module. Metallic button 424*b* will engage spring contact pin 227 of the drive module to deliver dc power to the tool, in one embodiment, housing collar and rod elements are metallic to act as a ground. End 424*c* at the uphole end of the rod may engage the lowermost gun sub which will carry dc power from the surface to the tool. O-rings are provided for static seal including an O-ring set 426 between the rod and collar cap 422*a*. O-ring 428 under compression between the inner walls of land 424*a* and moved end of the drive housing may also be provided. O-ring seals 430 are provided between the lower end of cylindrical section 425 of collar 422. Thus, multiple static seal elements are provided to seal the upper end of the electric setting tool 200 by sealing the upper end of the drive module.

In certain implementations, the setting tool can achieve a stroke of at least three inches with a tensile pull of at least 15,000 pounds in less than about 120 seconds using a power signal at the motor of less than about 1.9 amps and 600 volts. In particular implementations, the setting tool can achieve a stroke of at least three inches with a tensile pull of at least 15,000 pounds in less than about 60 seconds using a power signal at the motor of less than about 1.9 amps and 600 volts. In some implementations, the setting tool can achieve at least eight inches with a tensile pull of at least 15,000 pounds in less than about 60 seconds using a power signal at the motor of less than about 1.9 amps and 600 volts. In additional implementations, the setting tool can achieve at least eight inches with a tensile pull of at least 15,000 pounds in less than about 40 seconds using a power signal at the motor of less than about 1.9 amps and 600 volts. In other implementations, the setting tool can achieve at least eight inches with a tensile pull of at least 25,000 pounds in less than about 60 seconds using a power signal at the motor of less than about 1.9 amps and 600 volts. In certain implementations, the input power to the motor may also be less than about 750 watts, and in some implementations, less than about 500 watts. In particular implementation, the tensile pull may be about 50,000 pounds.

Figure 13:
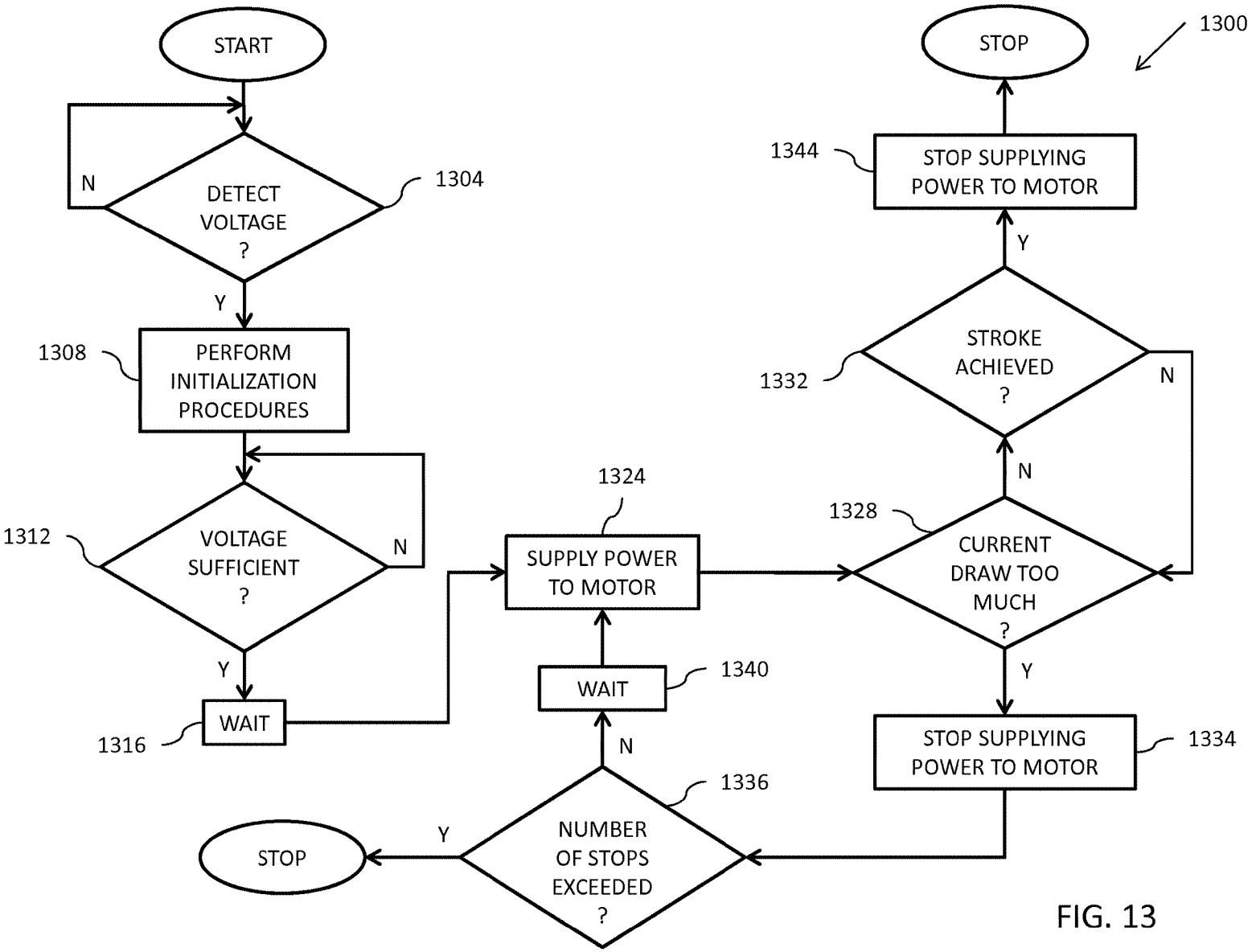
FIG. 13 is a flow chart illustrating an example process for controlling an electric setting tool.

FIG. 13 illustrates an example process 1300 for operating a downhole setting tool. Process 1300 may, for example, illustrate the operations of setting tool 12 or 200.

Process 1300 calls for detecting if a voltage has been applied to the setting tool (operation 1304). When the setting tool is lowered into a well, no power signal may be being applied to the setting tool (e.g., to keep the setting tool from activating prematurely). Once the setting tool is verified to be at the appropriate location (e.g., depth), voltage (e.g., 600 volts) may be applied to the setting tool (e.g., through a wireline suspending the setting tool). The setting tool may contain a voltage regulator that converts an applied voltage into one that can be used to power a controller (e.g., 3.3 volts), and a controller for the setting tool may be powered on using the converted voltage.

Process 1300 also calls for performing initialization procedures (operation 1308). For example, one or more controllers may boot up and check the condition of various setting tool devices (e.g., sensors, motor, communication devices, etc.).

Process 300 also calls for determining whether the applied voltage is sufficient for operating the setting tool (operation 1308). In particular implementations, for example, a controller may determine whether the applied voltage is above 300 volts. Once the motor is turning, having a high voltage is not particularly important. In certain implementations, for, example, the motor can turn with as little as 40 volts. If the applied voltage is not sufficient, process 1300 calls for waiting for the applied voltage to become sufficient.

If the voltage is sufficient, process 1300 calls for waiting for a predefined period of time (operation 1316). This wait period may, for example, be a few seconds long (e.g., 5 s). This provides a user on the surface the opportunity to abort operation of the setting tool if it has been activated prematurely (e.g., by removing power at the surface).

If the wait period expires, process 1300 calls for supplying power to the motor (operation 1324). Supplying power to the motor will cause the motor to rotate and a rod coupled to the motor (e.g., through a transmission assembly) to linearly stroke. For example, the rod may stroke a length of 6 inches over a period of 20-60 s.

During the stroke, process 1300 calls for determining whether the motor is drawing too much current (operation 1328). In particular implementations, for example, the current draw may be kept below 1.9 amps.

If the current draw is not too much, process 1300 calls for determining whether the stroke length has been achieved (operation 1332). The stroke length may, for example, be monitored by measuring rotations of the motor and/or the position of the rod. If the stroke length has not been achieved, process 1300 calls for monitoring whether the current draw is too much (operation 1328).

If the current draw is too much, process 1300 calls for stopping the supply of power to the motor (operation 1334). For example, a controller may terminate the power signal to the motor. Process 1300 also calls for determining whether the motor has been stopped too many times (operation 1336). If the motor has been stopped many times (e.g., 5), it typically indicates a problem is occurring with the motor, the transmission assembly, and/or the well tool and that the setting will not be successful given the current conditions and operating parameters.

If the motor has been stopped too many times, process 1300 is at an end. If the motor has not been stopped too many times, process 1300 calls for waiting a period of time (operation 1340) and then supplying power to the motor again (operation 1324). The period of time may, for example, be a few seconds (e.g., 1 s). The motor will continue to provide rotary motion to stroke the rod, and the controller may continue to determine whether the current draw is too much (operation 1328) and whether the stroke has been achieved (operation 1332).

If the stroke length is achieved, process 1300 calls for stopping the supply of power to the motor (operation 1344). Process 1300 is at an end.

Although FIG. 13 illustrates an example process for operating a downhole setting tool, other processes for operating a downhole setting tool may include fewer, additional, and/or a different arrangement of operations. For example, a process may include determine whether a start command has been received. Additionally, a process may include determining whether a start command has been received even if the voltage is insufficient. As another example, a process may include determining whether a programming command has been received. A programming command may, for example, specify the stroke length (e.g., in terms of motor rotations or actual rod movement) or maximum operating current. As an additional example, a process may include determining whether a stop command has been received. As another example, a process may not include determining whether the voltage is sufficient.

Figure 14:
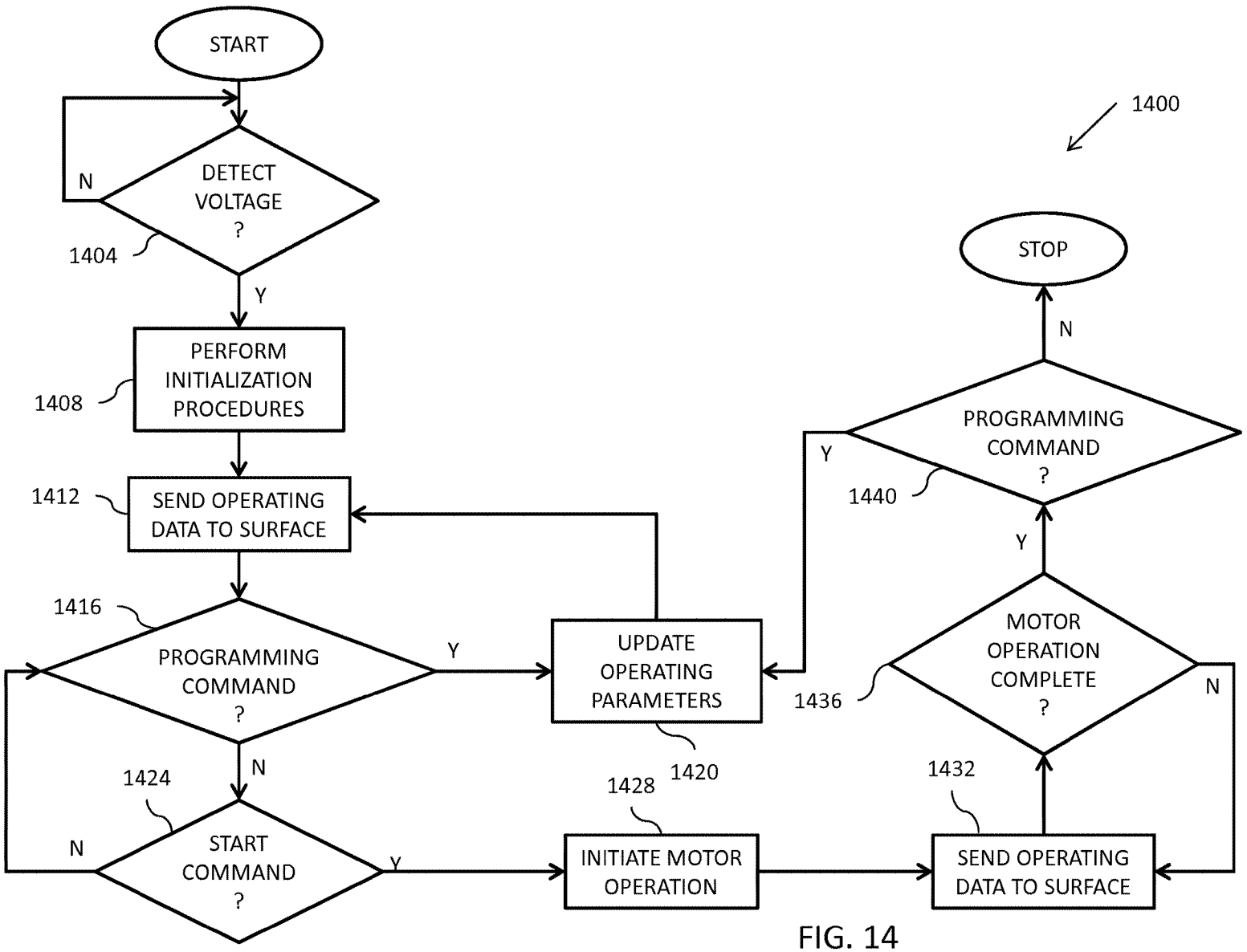
FIG. 14 is a flow chart illustrating an additional example process for controlling an electric setting tool.

FIG. 14 illustrates another example process 1400 for operating a downhole setting tool. Process 1400 may, for example, illustrate the operations of setting tool 12 or 200, and be used in conjunction with parts of process 1300.

Process 1400 calls for detecting if a voltage has been applied to the setting tool (operation 1404). When the setting tool is lowered into a well, no power signal may be being applied to the setting tool (e.g., to keep the setting tool from activating prematurely). Once the setting tool is verified to be at the appropriate location (e.g., depth), voltage (e.g., 400 volts) may be applied to the setting tool (e.g., through a wireline suspending the setting tool). The setting tool may contain a voltage regulator that converts the applied voltage into one that can be used to power a controller therein (e.g., 5 volts), and a controller for the setting tool may be powered on using the converted voltage.

Process 1400 also calls for performing initialization procedures (operation 1408). For example, one or more controllers may boot up and check the condition of various setting tool devices (e.g., sensors, motor, communications devices, etc.).

Process 1400 also calls for sending operating data to the surface of the well (operation 1412). The operating data may, for example, include data regarding the well (e.g., pressure, temperature, etc.), regarding the setting tool (e.g., current draw, stroke length, maximum operating current, etc.), and/or regarding the input power signal (e.g., volts, amps, etc.). The data may, for example, be sent to a computer system on the surface for presentation, storage, and analysis.

Process 1400 also includes determining whether a programming command has been received (operation 1416). The programming command may, for example, come from a computer system on the surface. If a programming command has been received, process 1400 calls for updating operating parameters for the setting tool (operation 1420). For example, the programming command may instruct the setting tool regarding stroke length, number of motor restarts, and/or maximum operating current. Once the operating parameters have been updated, process 1400 calls for again sending operating data to the surface (operation 1412). An operator may therefore verify that a programming command has been updated in the setting tool.

Process 1400 also calls for determining whether a start command has been received (operation 1424). A start command may, for example, be received from a computer system on the surface. If a start command has not been received, process 1400 calls for again determining whether a programming command has been received (operation 1416).

If a start command is received, process 1400 calls for initiating motor operation (operation 1428). For example, a power signal could be applied to the motor. The motor may, for example, be operated according to operations 1324-1340 in process 1300.

Process 1400 also calls for sending operating data to the surface (operation 1432). The operating data may, for example, include data regarding the well conditions (pressure, temperature, etc.), the setting tool (e.g., stroke length), or input power (e.g., current drawn).

Process 1400 further calls for determining whether the motor operation is complete (operation 1436). Determining whether the motor operation is complete may, for example, be accomplished by determining whether the stroke length has been achieved or a maximum number of restarts has been met. The stroke length may, for example, be monitored by measuring rotations of the motor and/or the position of the rod. If the motor operation is not complete, process 1400 calls for continuing to send the operating data to the surface (operation 1432).

If the motor operation is complete, process 1400 calls for determining whether a programming command has been received. A programming command may, for example, be received if an error occurred during the operation of the motor (e.g., if the setting tool is stuck). By sending programming commands, the setting tool may be operated differently. For example, if the setting tool is stuck, the maximum current limit may be increased (e.g., to the safety limit of the electronics or beyond).

In some cases, it may be advantageous to allow the setting tool to draw current above the level that the switches in the gun subs can handle (e.g., destroying the switches). If the setting tool can complete its operations at high current levels, then the perforating gun can be easily removed from the hole and reset. Having to remove the setting tool from the hole while the setting tool is attached to the well tool is much more difficult. Additionally, for implementations that do not use a perf gun, the current limit can be set to a higher amount.

Although FIG. 14 illustrates an example process for operating a downhole setting tool, other processes for operating a downhole setting tool may include fewer, additional, and/or a different arrangement of operations. For example, a process may not include determine whether a programming command or a start command has been received. Additionally, a process may include determining whether an input voltage is sufficient. As another example, a process may include determining whether a stop command has been received. As an additional example, a process may not include checking for receipt of a programming command before beginning operation or after operation. Additionally, operating data does not have to be sent to the surface during motor operation.

Figure 15A:
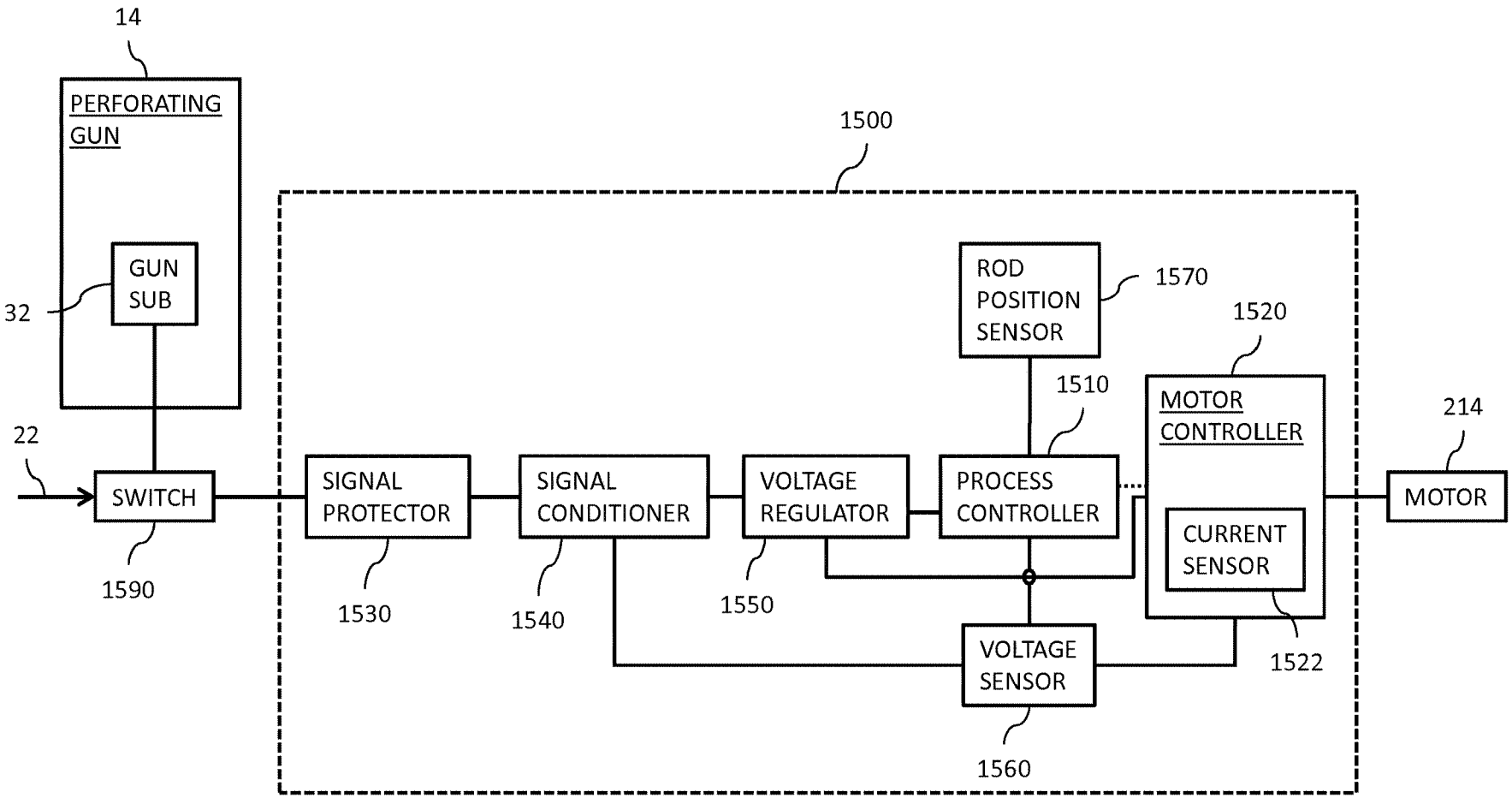
FIGS. 15A-15B are block diagrams illustrating example control systems for an electric setting tool.

FIG. 15A illustrates an example control system 1500 for a downhole setting tool, such as setting tool 12 or 200. Control system 1500 may, for example, be part of electronic control assembly 236. Among other things, control system 1500 includes a process controller 1510 and a motor controller 1520 for controlling a motor 214.

Process controller 1510 controls the overall operation of control system 1500. Process controller 1510 may, for example, include a processor (e.g., a microprocessor, a microcontroller, a field-programmable gate array, or an application specific integrated circuit) and memory (e.g., read-only memory, random access memory, and/or flash memory), which may store instructions and data.

Coupled to processor controller 1510 is a motor controller 1520. Motor controller 1520 controls the operation of motor like motor 214. For example, motor controller 1520 works to maximize the output power of the motor given the available input power. For instance, motor controller 1520 may take feedback from a resolver, which measures the angular position of motor 214, and the available voltage and time the electric field to the angle of the motor. Motor controller 1520 may, for example, include processor (e.g., a microprocessor, a microcontroller, a field-programmable gate array, or an application specific integrated circuit) and memory (e.g., read-only memory, random access memory, and/or flash memory), which may store instructions and data.

Control system 1500 also includes a signal protector 1530, a signal conditioner 1540, and a voltage regulator 1550. Signal protector 1530 protects control system 1500 from inappropriate signals (e.g., opposite polarity). Signal protector 1530 may, for example, include one or more diodes (e.g., Zener, Schottky, etc.). The diode may allow signals of one polarity and reject signals of another polarity (e.g., by creating a short). Signal conditioner 1540 conditions the power signal (e.g., smoothing and filtering). Signal conditioner 1540 may, for example, include one or more capacitors, which may prevent transients in the power signal. Voltage regulator 1550 converts the input voltage (typically in the 300-600 volt range) into a power signal (e.g., 3.3 volts) for various electronic components of control system 1500 (e.g., process controller 1510 and motor controller 1520).

Control system 1500 also includes a voltage sensor 1560. Voltage sensor 1560 senses the voltage of the power signal for the motor 214. Process controller 1510 may monitor the voltage of the power signal in certain implementations to make sure that it is appropriate for operation and for logging purposes. For example, the power signal may need to be above a certain level (e.g., 300 volts) for motor 214 to start operation. Voltage sensor 1560 may, for example, include a high impedance voltage bridge. The bridge may convert the sensed voltage into an analog signal (e.g., 0-3.3 volts) and convey this signal to process controller 1510, which may then determine what the voltage of the power signal is.

Control system 1500 also includes a current sensor 1522 in motor controller 1520. Process controller 1510 may monitor current being drawn by motor 214 in certain implementations to make sure that it is not exceeding a limit. For example, the current draw may need to stay below a certain level (e.g., 1.9 amps) to protect other electronics in the tool string. Current sensor 1522 may, for example, include a resistor network. The network may convert the sensed current into an analog signal (e.g., 0-3.3 volts), and motor controller 1520 may convey a representation of this signal to process controller 1510 across a communication link.

Rod position sensor 1570 senses the position of the rod performing the linear stroke. Rod position sensor 1570 may, for example, measure the angular position of the motor (e.g., a resolver) or the actual position of the rod. To measure the actual position of the rod, position sensor 1570 may be a linear transducer.

In certain modes of operation, the setting tool, of which control system 1500 is a part, is lowered into a well along with a perforating gun 14, having one or more gun subs 32.

Electrically coupled between the perforating gun 14 and the setting tool is a switch 1590, which controls which assembly (i.e., setting tool or perforating gun) receives electrical power. In particular implementations, switch 1590 is a diode that allows current of one polarity to travel to the setting tool and current of another polarity to travel to the perforating gun.

When the setting tool is at the appropriate location (e.g., depth), an electrical signal may be applied to switch 1590, which should allow electrical power to control system 1500. Upon receiving electrical power, voltage regulator generates an appropriate voltage and process controller 1510 and motor controller 1520 power on and initialize. As part of its initialization operations, motor controller 1522 may determine the status of motor 214 (e.g., sense the positions of the rotor and the stator).

Process controller 1510 then determines whether the applied voltage is sufficient for operating the setting tool, based on the data from voltage sensor 1560. In particular implementations, for example, the controller may determine whether the applied voltage is above 300 volts. If the applied voltage is not sufficient, the process controller may wait for the applied voltage to become sufficient.

Once the voltage is sufficient, process controller 1510 waits for a period of time, which may, for example, be a few seconds long (e.g., 10 s). This provides a user on the surface the opportunity to abort operation of the setting tool if it has been activated prematurely. After waiting, process controller 1510 sends an instruction to motor controller 1520 to begin operating motor 214. Motor controller 1520 then supplies power to motor 214 (e.g., at the correct phase). Supplying power to the motor will cause the motor to rotate and a rod coupled to the motor (e.g., through a transmission assembly) to linearly stroke. For example, the rod may stroke a length of 6 inches over a period of 20-60 s.

During the stroke, process controller 1510 monitors whether the motor is drawing too much current based on data from current sensor 1522. In particular implementations, for example, the current draw may be kept below 1.9 amps.

If the current draw is not too much, process controller 1510 determines whether the stroke length has been achieved based on data from rod position sensor 1570. If the stroke length has not been achieved, process controller 1510 continues monitoring whether the current draw is too much.

If the current draw is too much, process controller 1510 signals motor controller 1520 to stop supplying power to the motor 214. For example, the motor controller 1520 may terminate the power signal to the motor.

In certain implementations, process controller 1510 may track how many times the motor has been stopped and determine whether the motor has been stopped too many times. If the motor has been stopped many times (e.g., 5), it typically indicates a problem is occurring with the motor, transmission assembly, and/or well tool and that the setting will not be successful given the current conditions and operating parameters. If the motor has been stopped too many times, process controller 1510 may end the setting operations.

If the motor has not been stopped too many times, process controller 1510 may wait a period of time (e.g., 0.5 s) and then command motor controller 1520 to supply power to the motor again. The motor will continue to provide rotary motion to stroke the rod, and the process controller may continue to determine whether the current draw is too much and whether the stroke has been achieved.

If the full stroke is achieved, process controller 1510 may signal motor controller 1520 to cease stop supplying power to the motor. The operations are then at an end.

Although FIG. 15A illustrates an example control system for a downhole setting tool, other control systems for a downhole setting tool may include fewer, greater, and/or a different arrangement of components. For example, a control system may include a telemetry module for sending and receiving data from a surface computer system. As another example, the rod position sensor may be part of the motor controller. As a further example, a control system may be used without a perforating gun. As an additional example, the process controller and the motor controller may be part of the same controller. As a further example, a control system may include one or more sensors for sensing well conditions (e.g., pressure and/or temperature).

Figure 15B:
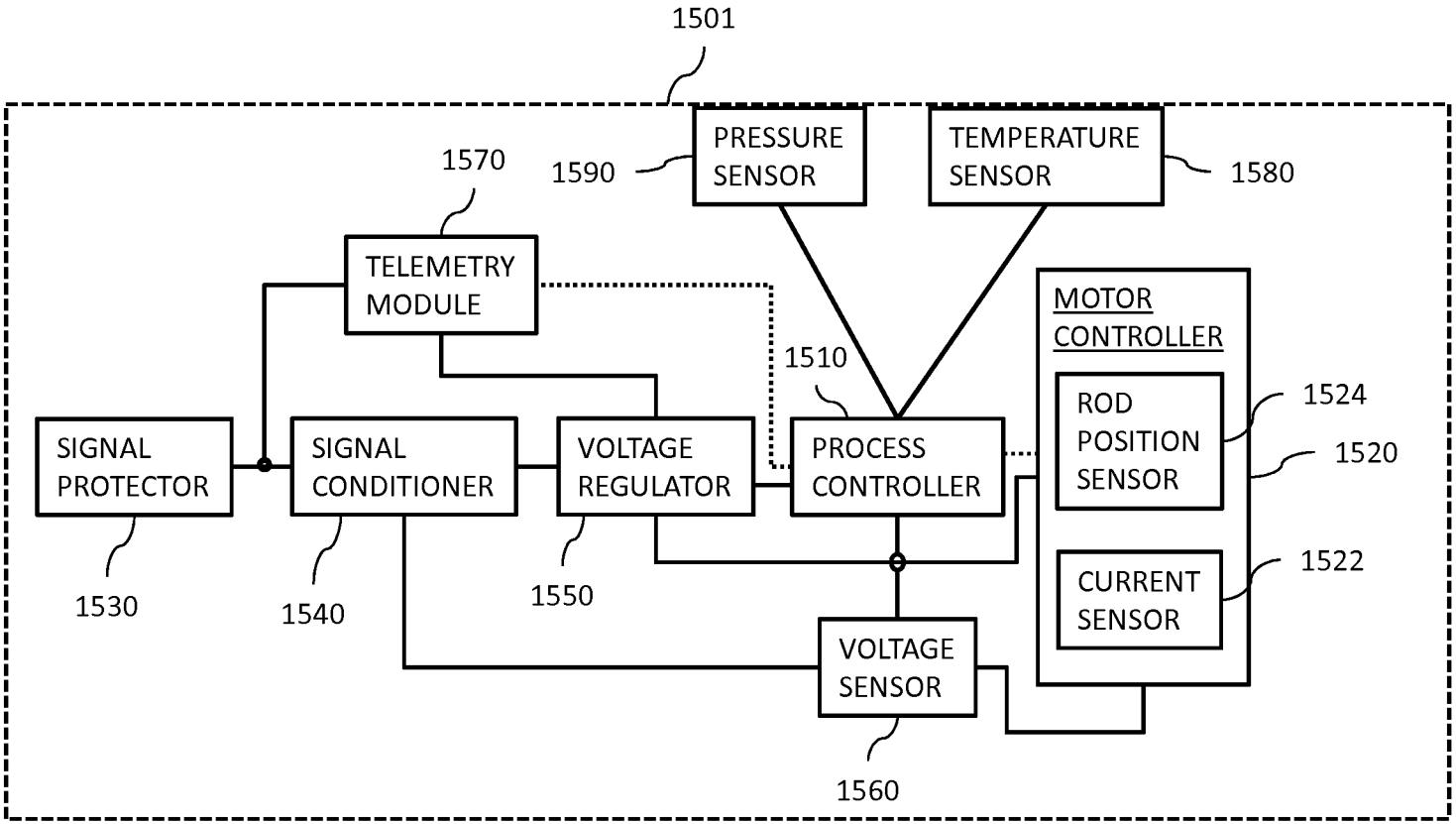

FIG. 15B illustrates another example control system 1501 for a downhole setting tool, such as setting tool 12 or 200. Control system 1500 may, for example, be part of electronic control assembly 236. Similar to control system 1500, control system 1501 includes a process controller 1510, a motor controller 1520, a signal protector 1530, a signal conditioner 1540, a voltage regulator 1550, and a voltage sensor 1560.

In this implementation, motor controller 1520 includes a rod position sensor 1524 along with current sensor 1522. Rod position sensor 1524 measures the angular position of the motor. The angular position of the motor may be directly related to the position of the rod through the thread pitch of the motion convertor. In certain implementations, rod position sensor 1524 may be a resolver. Motor controller 1520 passes the angular position of the motor to process controller 1510 over a data link.

Control system 1501 also includes a telemetry module 1570. Telemetry module 1570 is responsible for receiving data for and sending data from control system 1501 (e.g., while in the well). Telemetry module 1570 may receive power from voltage regulator 200140 and communicate with process controller 1510 over a data link.

To receive and send data, telemetry module 1570 may use a high frequency carrier signal to extract and embed data on the power signal. As illustrated, the power signal may be fed to the telemetry module 1570 before encountering the signal conditioner 1540, which removes transients and may affect the carrier signal. The ASCII protocol may be used to send data. The telemetry module may, for example, include a universal asynchronous receiver transmitter (UART) for converting the data to a form useful by processors in the telemetry module.

Using telemetry module 1570, control system 1501 may receive and send a variety of data. For example, process controller 1510 may receive start and/or stop commands for beginning and ending motor operation. As an additional example, the process controller may receive operating parameters (e.g., stroke length, maximum operating current, number of restarts, etc.) before beginning operation and convey operating data (e.g., stroke length, operating current, restarts, etc.) to the surface.

Control system 1501 also includes a pressure sensor 1580 and a temperature sensor 1590. Temperature sensor 1580 may, for example, be a thermocouple coupled to the inside of the setting tool's outer casing. Although the thermocouple may take a while to accurately sense the outer temperature (e.g., until an equilibrium is reached inside the setting tool), it may rapidly provide an indication that the temperature outside the setting tool is well outside of expected operating conditions. Pressure sensor 1590 may, for example, be an industry standard low-profile sensor fitted into a threaded journal. The pressure sensor may, for example, be embedded into the wall of the drive module (e.g., at a bulkhead). Process controller 1510 may send data regarding the well (e.g., pressure and temperature) to the surface and/or store it for later retrieval.

In certain modes of operation, the setting tool, of which control system 1501 is a part, is lowered into a well. When the setting tool is at the appropriate location (e.g., depth), an electrical signal may be applied that should allow electrical power to control system 1501 (e.g., be accepted by signal protector 1530). Upon receiving electrical power, voltage regulator 1550 generates an appropriate voltage, and process controller 1510 and motor controller 1520 power on and initialize. As part of its initialization operations, motor controller 1520 may determine the status of the associated motor (e.g., sense the positions of the rotor and the stator).

Process controller 1510 then determines the applied voltage based on output from voltage sensor 1560 and sends the applied voltage and the operating parameters (e.g., current limit, stroke length, etc.) to the surface through telemetry module 1570. Process controller 1510 may also send well data (e.g., pressure and temperature) to the surface. The process controller then waits to receive a programming command or a start command from the surface.

If process controller 1510 receives a programming command, the process controller updates its operating parameters and send the updated operating parameters to the surface. If the process controller 1510 receives a start command, it may command motor controller 1520 to start the associated motor (not shown).

Motor controller 1520 then supplies power to the motor (e.g., at the correct phase). Supplying power to the motor will cause the motor to rotate and a rod coupled to the motor (e.g., through a transmission assembly) to linearly stroke. For example, the rod may stroke a length of 3 to 12 inches over a period of 20-60 s.

During the stroke, process controller 1510 monitors whether the motor is drawing too much current based on data from current sensor 1522. In particular implementations, for example, the current draw may be kept below 1.9 amps.

If the current draw is not too much, process controller 1510 determines whether the stroke length has been achieved based on data from rod position sensor 1524. If the stroke length has not been achieved, process controller 1510 continues monitoring whether the current draw is too much.

If the current draw is too much, process controller 1510 signals motor controller 1520 to stop supplying power to the motor. For example, the motor controller may terminate the power signal to the motor.

In certain implementations, process controller 1510 may track how many times the motor has been stopped and determine whether the motor has been stopped too many times. If the motor has been stopped many times (e.g., 10), it typically indicates a problem is occurring with the motor, transmission assembly, and/or well tool and that the setting will not be successful given the current conditions and operating parameters. If the motor has been stopped too many times, process controller 1510 may end the setting operations.

If the motor has not been stopped too many times, process controller 1510 may wait a period of time (e.g., 2 s) and then command motor controller 1520 to supply power to the motor again. The motor will continue to provide rotary motion to stroke the rod, and the process controller may continue to determine whether the current draw is too much and whether the stroke has been achieved.

If the full stroke is achieved, process controller 1510 may signal motor controller 1520 to stop supplying power to the motor. The operations are then at an end.

Although FIG. 15B illustrates an example control system for a downhole setting tool, other control systems for a downhole setting tool may include fewer, greater, and/or a different arrangement of components. For example, a control system may not include a telemetry module for sending and receiving data from a surface computer system. As another example, the rod position sensor may not be part of the motor controller. As a further example, a control system may be used with a perforating gun. As an additional example, the process controller and the motor controller may be part of the same controller. As a further example, a control system may not include a pressure sensor and/or a temperature sensor.

Figure 16A:
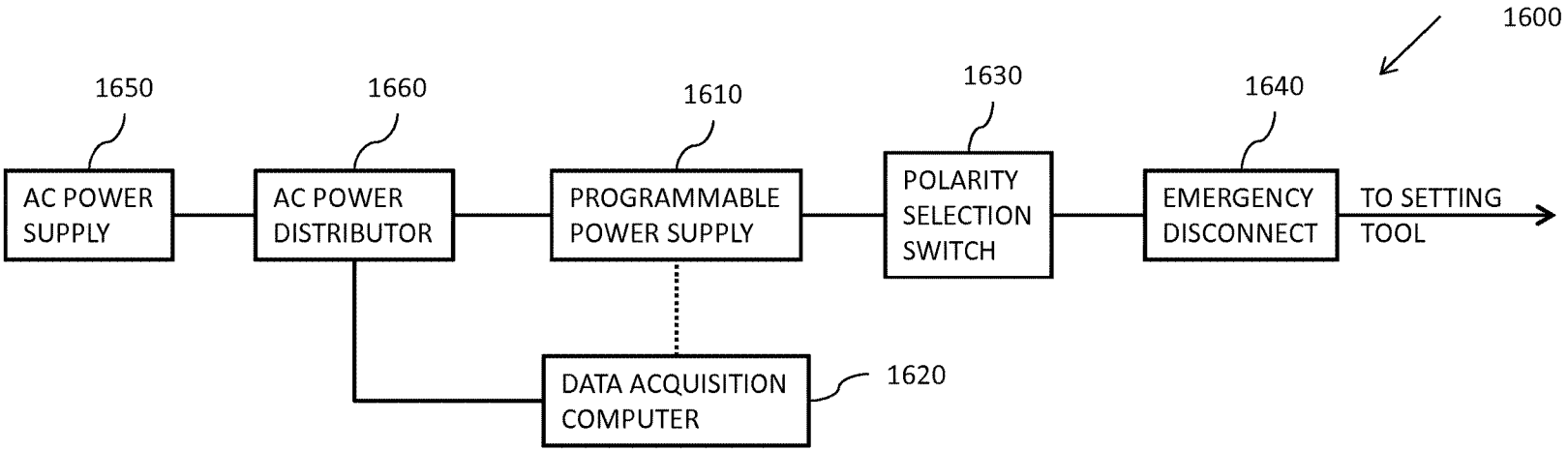
FIGS. 16A-16B are block diagrams illustrating example surface control systems for an electric setting tool.
Figure 16B:
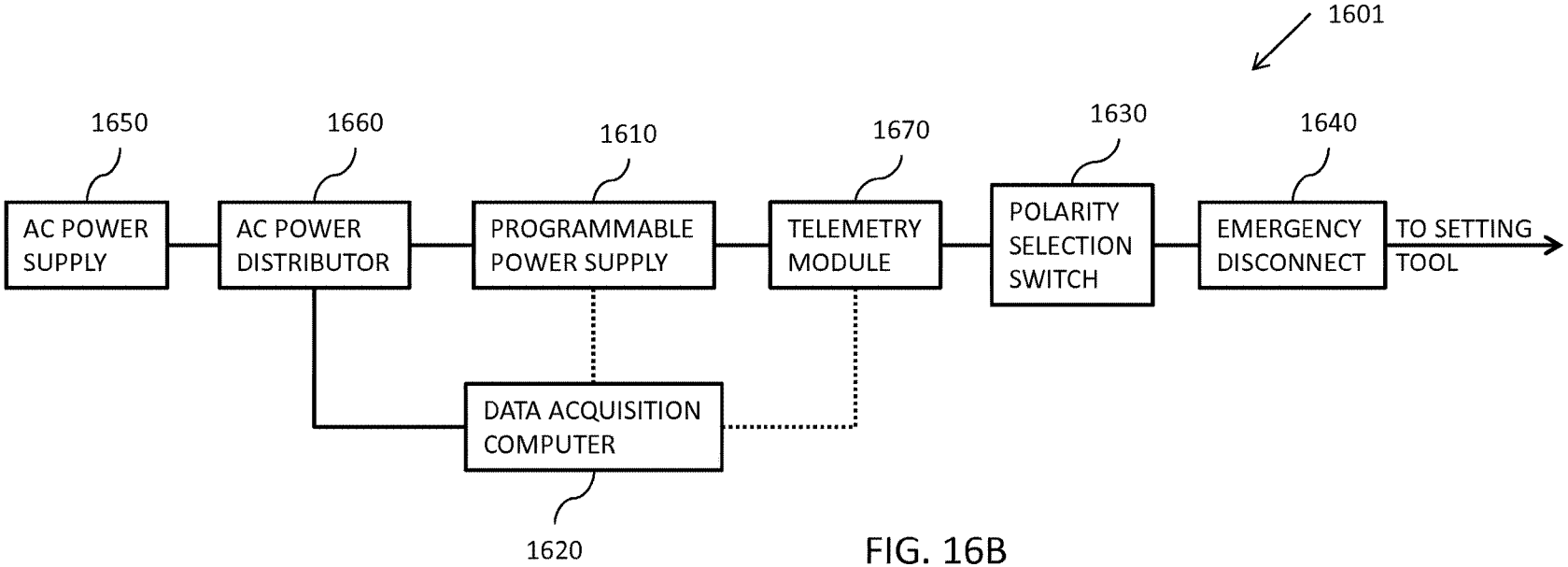

FIG. 16A illustrates an example surface control system 1600, and FIG. 16B illustrates another example surface control system 1601. Among other things, control systems 1600-1601 include a programmable power supply 1610 and a data acquisition computer 1620.

Programmable power supply 1610 is operable to convert an AC input signal into a DC output signal. Additionally, programmable power supply 1610 is adapted to set and limit voltage and current of the output DC signal. The programmable power supply may, for example, be a Gen 600-26 from TDK-Lambda Corporation of Tokyo, Japan.

In particular implementations, for example, the programmable power supply may be set at the operating limits of the downhole electronics (e.g., 600 volts and 1.9 amps). This may serve as an extra safety feature for the downhole electronics, although it is typically not as accurate for conditions that occur downhole. For instance, if the downhole electronics experience or create a short, programmable power supply 1610 may prevent the power signal from reaching intolerable levels.

The voltage applied and measured at the surface (e.g., 600 volts) is typically not the voltage seen by the setting tool in the well. Due to voltage drops uphole of the setting tool (for example, in the wireline), the setting tool receives less than the voltage applied at the surface. Thus, when the power input to or at the motor is referenced, it is current times voltage at the motor.

Data acquisition computer 1620 communicates with programmable power supply 1610 to send commands thereto and receive data therefrom. By sending commands to programmable power supply 1610, data acquisition computer 1620 may configure the programmable power supply (e.g., to set voltage and current limits). By receiving data from the programmable power supply 1610, data acquisition computer 1620 may provide the data to a user (e.g., on a display) and store it for later recall and analysis.

Data acquisition computer 1610 may, for example, include a processor, memory, which may store instructions and data, a display, and a communication interface. Data acquisition computer 1620 and programmable power supply 1610 may, for example, communicate over an RS-232 link.

In certain modes of operation, data acquisition computer 1610 may receive electrical readings from programmable power supply 1610. For instance, data acquisition computer 1610 may receive an indication of the current flowing into the well. The current may be plotted on a display of the data acquisition computer. Additionally, the current readings may be stored by the data acquisition computer (e.g., in a .CSV file) with a time stamp and date.

Figure 17:
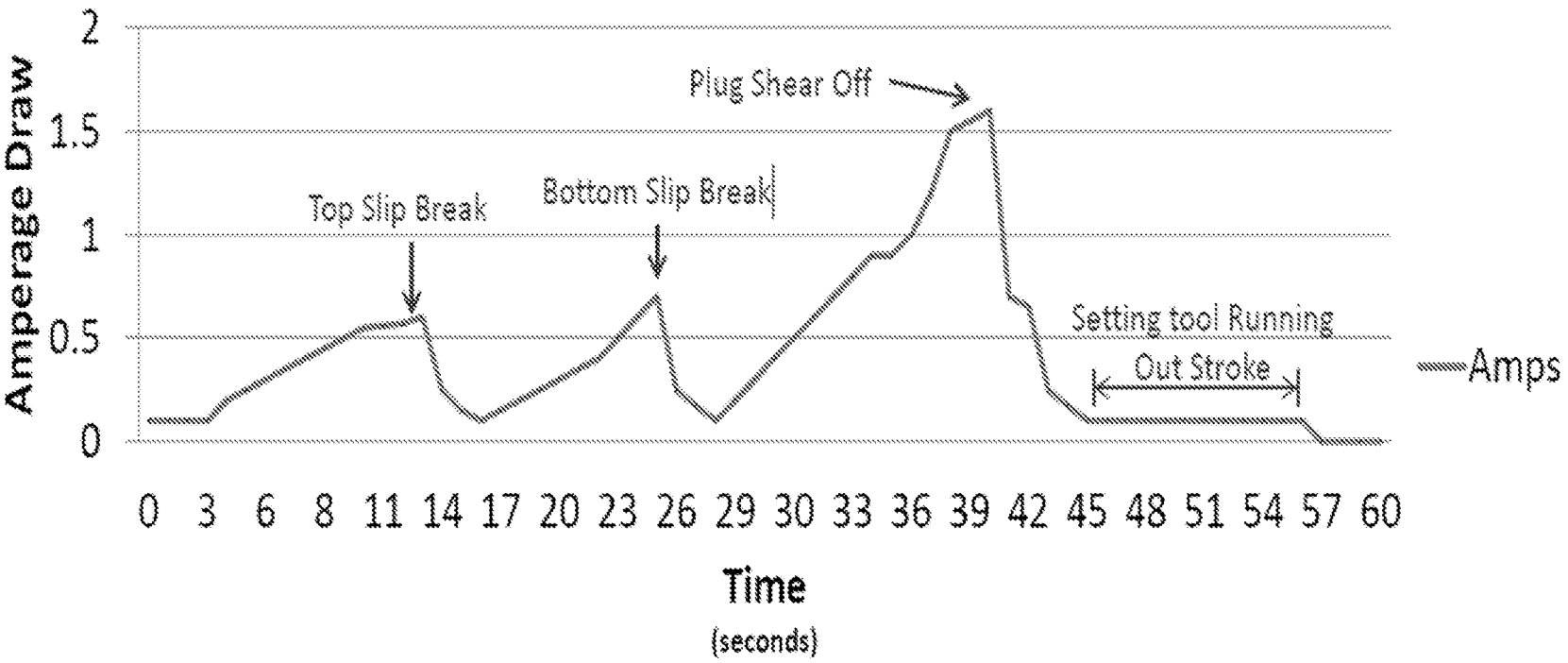
FIG. 17 is a plot illustrating the example operation of an electric setting tool

FIG. 17 illustrates an example plot of current versus time for the setting of a bridge plug. As illustrated, readily identifiable points in the operation of the setting tool may be observed from the plot. For example, the setting tool begins running at a fairly low current level and then begins to draw more current as the sealing member begins to expand. Then, the top slip expands and breaks, drawing more current. The setting tool then draws a lower current until the lower slip begins to expand and break. The setting tool then again draws a lower current until the slips begin to engage the casing. The current draw continues to increase as the slips become embedded in the casing, allowing no more movement, and the setting tool is forced to shear off the mandrel. Then, the current draw drops rapidly as the setting tool continues the stroke motion in a relatively unimpeded manner. Finally, once the stroke length has been achieved, the setting tool stops supplying power to the motor and now more current is drawn.

By allowing operating parameters (e.g., drawn current) to be presented on the surface, surface control system 1600 allows an operator to have an indication of what is occurring with the setting tool and to have an appreciation as to whether it functioned correctly and the plug was set. With prior art setting tools (e.g., ballistic), there is no indication as to whether the setting tool functioned correctly and the plug is set.

Surface control system 1600 also includes a polarity selection switch 1630, an emergency disconnect 1640, an AC power supply 1650, and an AC power distributor 1660. Polarity selection switch 1630 is adapted to switch the polarity of the signal traveling to the setting tool. Thus, the motor may receive a first polarity, and after its operations are complete, a perforating gun may receive a second polarity. In particular implementations, polarity selection switch 1630 may be manually operated. Emergency disconnect 1640 allows the power signal going into the well to be shut off quickly.

AC power supply 1650 supplies the power for surface controller system 1600. AC power supply 1650 may, for example, be a portable generator. AC power distributor 1660 distributes AC power to programmable power supply 1610 and data acquisition computer 1620.

Surface control system 1601 is similar to surface control system 1600 except that it includes a telemetry module 1670. Telemetry module 1670 is responsible for sending data to and receiving from a control system for the setting tool (e.g., while in the well). Telemetry module 1670 may receive instructions from and communicate data to data acquisition computer 1620 (e.g., over an RS-232 link).

To send and receive data, telemetry module 1670 may use a high frequency carrier signal to embed data on and extract data from the power signal. The telemetry module may, for example, include a universal asynchronous receiver transmitter (UART) for converting the data to a form useful by processors in the telemetry module.

Using telemetry module 1670, data acquisition computer 1620 may send and receive a variety of data. For example, the data acquisition computer may send start and/or stop commands for beginning and ending motor operation. As an additional example, the data acquisition computer may send operating parameters (e.g., stroke length, maximum operating current, number of restarts, etc.) before beginning motor operation and receive operating data (e.g., stroke length, operating current, etc.) and well condition data (e.g., temperature, pressure, etc.). This data may be displayed to a user and/or stored in memory for later recall.

In certain implementations, the gun subs may use intelligent switches. These switches allow each switch to be individually communicated with from the surface. Thus, for example, when the tool string has been positioned in the well the switches may be interrogated and they may report back their status. Each switch may then be individually addressed to arm its gun sub and then to detonate its gun sub.

In these configurations, the switches may have the same polarity, so that they can see the same signals. Thus, the control system for the setting tool may be set to receive the opposite polarity.

In particular implementations, the setting tool may allow its lead wires conveying the power signal to be crossed. Thus, for example, if the setting tool is originally wired to accept positive polarity signals, it may be switched to receiving negative polarity signals by having its input wires crossed. The positive polarity signal would appear to present a negative voltage differential (e.g., 0-400 volts) and be shunted by the signal protector. A negative polarity signal, however, would present a positive differential (e.g., 0--400 volts) and be accepted by the drive module electronics.

If the setting tool is not wired properly, it is still in positive polarity, for example, the process module should be able to activate when the signals are sent to the intelligent switches, but it should not be able to drive the motor as the voltage for the intelligent switches is in the few tens of volts (e.g., 30 volts nominal).

Figure 18:
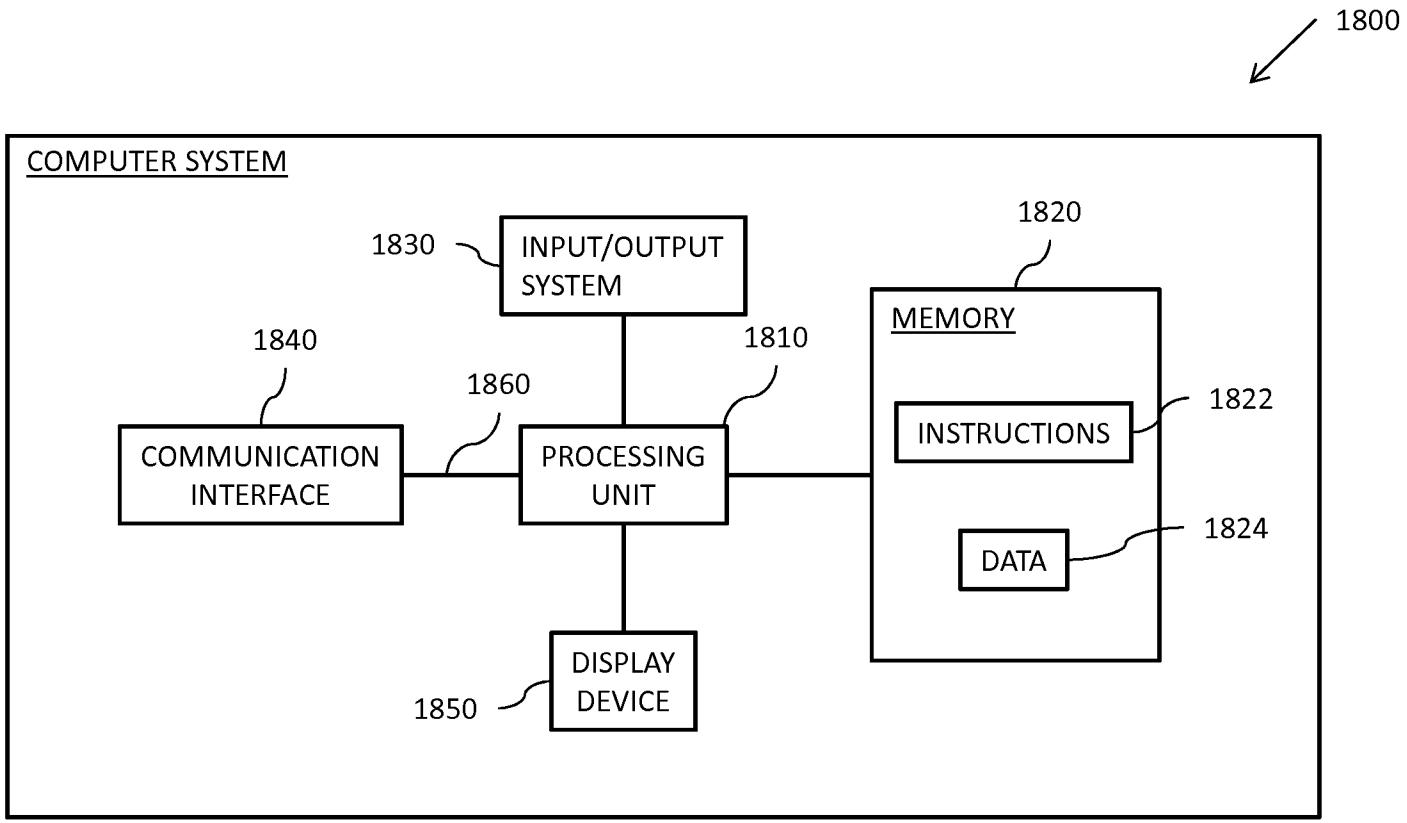
FIG. 18 is a block diagram illustrating an example computer system for an electric setting tool.

FIG. 18 illustrates selected components of an example computer system 1800 for controlling an electric setting tool. System 1800 may, for example, be part of a controller located in the well or on the surface. System 1800 includes a processing unit 1810, memory 1820, and an input-output system 1830, which are coupled together by a network system 1860.

Processing unit 1810 may include one or more processors for calculating data. A processor, for example, be a microprocessor, which could, for instance, operate according to reduced instruction set computer (RISC) or complex instruction set computer (CISC) principles, a microcontroller, a field-programmable gate array, or an application specific integrated circuit. In general, processing unit 1810 may be any device that manipulates information in a logical manner.

Memory 1820 may, for example, include random access memory (RAM), read-only memory (ROM), flash memory, and/or disc memory. Various items may be stored in different portions of the memory at various times. Memory 1820, in general, may be any combination of devices for storing information.

Memory 1820 includes instructions 1822 and data 1824. Instructions 1822 may, for example, include an operating system (e.g., Windows, Linux, or Unix) and one or more applications, which may be responsible for controlling a downhole setting tool (e.g., determining whether the setting tool should operate, monitoring setting tool operations, reporting setting tool data to the surface, etc.). Data 1824 may also include data acquired in the well (pressure, temperature, etc.) and during operation of the electric setting tool (e.g., current draw, stroke length, restarts, etc.).

Input-output system 1830 may, for example, include one or more user interfaces. A user interface could, for instance, include one or more user input devices (e.g., a keyboard, a keypad, a touchpad, a stylus, a mouse, or a microphone) and/or one or more user output devices (e.g., a speaker). In general, communication interface 1820 may include any combination of devices by which a computer system can receive and output information. Input-output system 1830 may, for example, be present on a surface computer system and not present on a downhole computer system.

Communication interface 1840 allows computer system 1800 to communicate with other electronic devices. Communication interface may, for example, be a network interface card (whether wireless or wireless), a modem, a UART, or a serial port.

Display device 1850 is responsible for visually present data acquired by and/or generated by processing unit 1810. Display device may, for example, be a liquid crystal display (LCD), a light emitting diode (LED) display, a cathode ray tube (CRT) display, or a projector. Display device 1850 may, for example, be present on a surface computer system and not present on a downhole computer system.

Network system 1860 is responsible for communicating information between processor 1810, memory 1820, input-output system 1830, communication interface 1840, and display device 1850. Network system 1860 may, for example, include a number of different types of busses (e.g., serial and parallel).

In certain modes of operation, computer system 1800 may determine whether voltage has been detected and whether the voltage is sufficient. Computer system 1800 may then determine whether to start a motor of a downhole setting tool (e.g., based on a wait time or a start command). During motor operation, computer system 1800 may monitor the current draw of the motor and/or the stroke of a rod that is being driven by the motor. If the current draw is too high, the computer system may turn the motor off and attempt to restart it a number of times. If the rod being driven by the motor achieves the desired stroke, the computer system may also turn the motor off.

In some implementations, the computer system may receive commands from a remote computer system (e.g., on the surface). For example, the commands may instruct the computer system regarding the stroke length, number of restart attempts, and maximum allowable current. The computer system may then control the motor according to these parameters. Additionally, the computer system may report operating conditions (e.g., well conditions and operating parameters) to the surface.

Computer system 1800 may implement any of the other procedures discussed herein, to accomplish these operations.

The terminology used herein is for the purpose of describing particular implementations only and is not intended to be limiting. As used herein, the singular form "a", "an", and "the" are intended to include the plural forms as well, unless the context clearly indicates otherwise. It will be further understood that the terms "comprises" and/or "comprising," when used in the this specification, specify the presence of stated features, integers, steps, operations, elements, and/or components, but do not preclude the presence or addition of one or more other features, integers, steps, operations, elements, components, and/or groups therefore.

The corresponding structure, materials, acts, and equivalents of all means or steps plus function elements in the claims below are intended to include any structure, material, or act for performing the function in combination with other claimed elements as specifically claimed. The description of the present implementations has been presented for purposes of illustration and description, but is not intended to be exhaustive or limited to the implementations in the form disclosed. Many modifications and variations will be apparent to those of ordinary skill in the art without departing from the scope and spirit of the disclosure. The implementations were chosen and described in order to explain the principles of the disclosure and the practical application and to enable others or ordinary skill in the art to understand the disclosure for various implementations with various modifications as are suited to the particular use contemplated.

A number of implementations have been described for implementing an electric setting tool, and several others have been mentioned or suggested. Moreover, those skilled in the art will readily recognize that a variety of additions, deletions, modifications, and substitutions may be made to these implementations while still achieving an electric setting tool. Thus, the scope of the protected subject matter should be judged based on the following claims, which may capture one or more concepts of one or more implementations.

The invention claimed is:

1. A downhole setting tool for use on a wireline with and below a perforation gun, and above a settable well implement, the perforation gun having an electrical switch, such that electrical current to the downhole setting tool runs through the switch, the setting tool comprising:

a housing adapted to be run into a well on the wireline;

a direct current (DC) motor powered down the wireline to provide rotary motion; and a transmission assembly driven by the DC motor and adapted to convert the rotary motion to a linear stroke, the DC motor having sufficient torque and the transmission assembly having sufficient reduction to provide a stroke of at least 3 inches with a tensile pull of at least 15,000 pounds in less than two minutes using a power signal at the motor of less than a maximum rated current of the electrical switch of the perforation gun and 600 volts.

2. The downhole setting tool of claim 1, wherein the transmission assembly comprises a gear box driven by the motor and a screw or other member rotationally driven by the gear box.

3. The downhole setting tool of claim 2, wherein the gear box provides a reduction of approximately in the range of 30:1 to 350:1.

4. The downhole setting tool of claim 2, wherein the gear box comprises a planetary gear assembly.

5. The downhole setting tool of claim 4, wherein the planetary gear assembly comprises a ring gear.

6. The downhole setting tool of claim 5, wherein the ring gear is part of the housing.

7. The downhole setting tool of claim 2, wherein the transmission assembly includes a motion convertor adapted to convert the rotary motion of the screw into linear motion.

8. The downhole setting tool of claim 1, further comprising an assembly adapted to prevent rotation of the setting tool.

9. The downhole setting tool of claim 1, wherein the motor and the transmission assembly are adapted to provide a stroke of at least 3 inches with a tensile pull of at least 15,000 pounds in less than about 60 seconds using an input power to the motor of less than 1200 watts at the surface.

10. The downhole setting tool of claim 1, wherein the motor and the transmission assembly are adapted to provide a stroke of at least 8 inches with a tensile pull of at least 15,000 pounds in less than about 60 seconds using an input power to the motor of less than 1200 watts at the surface.

11. The downhole setting tool of claim 1, wherein the motor and the transmission assembly are adapted to provide a stroke of at least 8 inches with a tensile pull of at least 15,000 pounds in less than about 40 seconds using an input power to the motor of less than 1200 watts at the surface 750 watts.

12. The downhole setting tool of claim 1, wherein the motor and the transmission assembly are adapted to provide a stroke of 8 inches with a tensile pull of at least 15,000 pounds in less than about 60 seconds using an input power to the motor of less than 500 watts.

13. The downhole setting tool of claim 1, wherein the setting tool further comprises a controller, the controller adapted to determine when sufficient power is available to operate the setting tool and to activate the setting tool when sufficient power is available.

14. The downhole setting tool of claim 13, wherein the controller is further adapted to send data regarding the operation of the setting tool while downhole in the well to a computer system located on the surface of the well.

15. The downhole setting tool of claim 13, wherein the controller is adapted to monitor the current draw of the motor and to stop the motor if the current draw is above 1.9 amps.

16. The downhole setting tool of claim 13, wherein the controller is adapted to restart the motor after waiting a specified period of time.

17. The downhole setting tool of claim 13, wherein the controller is adapted to be programmed while downhole in the well.

18. The downhole setting tool of claim 15, wherein the current limited switch has a maximum current limit of approximately 1.9 amps, and the controller is adapted to be programmed while downhole in the well to allow the current to the motor to exceed 1.9 amps.

19. The downhole setting tool of claim 15, wherein the controller is adapted to be programmed while downhole in the well to adjust the stroke length.

20. The downhole setting tool of claim 13, wherein the controller is adapted to monitor the stroke length and to stop the motor when the full stroke has been achieved.

21. The downhole setting tool of claim 1, further comprising a gauge incorporated inside the housing, the gauge adapted to measure one or of more fluid parameters in the well.

22. The downhole setting tool of claim 21, wherein the setting tool is adapted to send data regarding the fluid parameter to a computer system located at the top of the well.

23. The downhole setting tool of claim 1, wherein the motor and transmission assembly are adapted to provide a stroke, of at least 3 inches, with a tensile pull of at least 4,000 lbs.

24. A downhole setting tool for use on a wireline with and below a perforation gun, the perforation gun having an electrical switch, such that electrical current to the downhole setting tool runs through the switch, the setting tool comprising:

a housing adapted to be run into a well on the wireline;

a direct current (DC) motor powered down the wireline to provide rotary motion; and a transmission assembly driven by the DC motor and adapted to convert the rotary motion to a linear stroke, the DC motor having sufficient torque and the transmission assembly having sufficient reduction to provide a stroke of at least 3 inches with a tensile pull of at least 15,000 pounds in less than two minutes using a power signal at the motor of less than a maximum rated current of the electrical switch of the perforation gun; and a controller programmed to determine when sufficient power is available to operate the setting tool, activate the motor when sufficient power is available, monitor the current draw of the motor, and stop the motor if the current draw is above the maximum rated current of the perforation gun electrical switch.

25. The downhole setting tool of claim 24, wherein the controller is further programmed to send data regarding the operation of the setting tool while downhole in the well to a computer system located on the surface of the well.

26. The downhole setting tool of claim 24, wherein the controller is further programmed to automatically restart the motor after waiting a specified period of time since stopping the motor.

27. The downhole setting tool of claim 24, wherein the controller is further programmed to be programmed while downhole in the well.

28. The downhole setting tool of claim 24, wherein the controller is further programmed to be programmed while downhole in the well to allow the current to the motor to exceed the maximum rated current for the perforation gun.

29. The downhole setting tool of claim 24, wherein the controller is further programmed to be programmed while downhole in the well to adjust the stroke length.

30. The downhole setting tool of claim 24, wherein the controller is further programmed to monitor the stroke length and to stop the motor when the full stroke has been achieved.

31. The downhole setting tool of claim 24, further comprising a gauge incorporated inside the housing, the gauge adapted to measure one or more fluid parameters in the well.

32. The downhole setting tool of claim 31, wherein the setting tool is adapted to send data regarding the fluid parameter to a computer system located at the top of the well.

* * * * *